US010273754B2

(12) United States Patent
Niemczyk

(10) Patent No.: US 10,273,754 B2
(45) Date of Patent: Apr. 30, 2019

(54) MOBILE DRILLING RIG

(71) Applicant: Andrew Niemczyk, Hazel Park, MI (US)

(72) Inventor: Andrew Niemczyk, Hazel Park, MI (US)

( * ) Notice: Subject to any disclaimer, the term of this patent is extended or adjusted under 35 U.S.C. 154(b) by 424 days.

(21) Appl. No.: 14/865,156

(22) Filed: Sep. 25, 2015

(65) Prior Publication Data

US 2016/0090788 A1 Mar. 31, 2016

Related U.S. Application Data

(60) Provisional application No. 62/055,158, filed on Sep. 25, 2014.

(51) Int. Cl.
*E21B 7/02* (2006.01)

(52) U.S. Cl.
CPC ..... *E21B 7/023* (2013.01); *E21B 7/024* (2013.01)

(58) Field of Classification Search
CPC ..... E21B 7/02; E21B 7/023; E21B 7/024
See application file for complete search history.

(56) References Cited

U.S. PATENT DOCUMENTS 2,646,968 A 4/1953 Curtis
2,745,637 A 5/1956 Ball
2,754,087 A 7/1956 Johnson
3,500,938 A 3/1970 Watson
3,712,385 A 1/1973 Hunt
3,719,238 A 3/1973 Campbell et al.
3,917,005 A 11/1975 Cannon et al.
4,271,879 A 6/1981 Shivers, Jr. et al.
4,368,602 A * 1/1983 Manten ..... E21B 7/024 173/28
4,567,990 A 2/1986 Bellio
4,595,065 A 6/1986 Wada et al.
5,363,925 A 11/1994 Gallagher
5,570,975 A 11/1996 Reinert, Sr.
5,636,699 A * 6/1997 Pitman, I ..... B60K 17/342 175/203
5,697,457 A * 12/1997 Back ..... E21B 7/023 173/148
5,778,988 A 7/1998 Ilomaki
5,794,723 A 8/1998 Cancer, Jr. et al.
5,921,337 A * 7/1999 Okamoto ..... E02F 9/028 180/41
6,109,463 A 8/2000 Cullity
6,257,349 B1 * 7/2001 Bardwell ..... E21B 7/022 173/147

(Continued)

*Primary Examiner* — Nicole Coy
(74) *Attorney, Agent, or Firm* — John R. Benefiel

(57) ABSTRACT

A mobile drilling rig is mountable on a separate drive chassis having running gear. A separate main frame may be having elongated members, each having outer end extensions and vertically adjustable support posts thereon. A slide chassis is slidable on one end of the main frame mounting a power plant, and a mast pivot support pivotally mounted on the other end of the main frame. An elongated mast has a drill head movable thereon, with the mast pivot support slidably mounting the mast thereon so that the mast may be pivoted between vertical and horizontal orientations thereon while being movable in lengthwise directions. The slide chassis, the mast and drill head are moved to positions improving the stability of the rig when traversing grades in an up or down hill direction.

19 Claims, 23 Drawing Sheets

(56) References Cited

U.S. PATENT DOCUMENTS

| | | | | |
|---|---|---|---|---|
| 6,533,045 | B1 | 3/2003 | Cooper | |
| 6,568,547 | B1 | 5/2003 | Kretschmer et al. | |
| 6,857,483 | B1 | 2/2005 | Dirks et al. | |
| 7,249,629 | B2 * | 7/2007 | Cunningham | E21B 7/024 166/77.1 |
| 9,657,524 | B2 * | 5/2017 | Klein | E21B 3/02 |
| 2004/0226712 | A1 * | 11/2004 | Hood | E21B 7/022 166/66 |
| 2016/0097238 | A1 * | 4/2016 | Marek | E21B 7/024 248/188.3 |

* cited by examiner

MOBILE DRILLING RIG

CROSS REFERENCE TO RELATED APPLICATIONS

This application is a continuation in part of U.S. Ser. No. 14/702,853 filed on May 4, 2015, and claims the benefit of U.S. application Ser. No. 62/055,158 filed on Sep. 25, 2014, and U.S. provisional patent application Ser. No. 62/119,316 filed on Feb. 23, 2015.

BACKGROUND OF THE INVENTION

The present application concerns drilling rigs for boring holes into the ground and more particularly mobile rigs which can traverse the land to sites where holes are to be bored into the ground for various purposes, i.e. to create oil or water wells, for obtaining core samples, etc.

Such mobile drilling rigs are known but are not well suited to traverse many off road conditions and to safely negotiate rugged terrain with areas of steep grades.

Such rigs are typically limited in the depths of drilling possible since the drilling apparatus is not adequately stabilized to allow deep wells to be drilled and the vertical reaction forces become quite substantial when deep holes are attempted to be drilled.

Such rigs also tend to be quite expensive to build and maintain due to their complexity.

It is an object of the present invention to provide a general purpose mobile drilling rig which is able to easily and safely negotiate more rugged terrain and varying surface conditions than prior mobile drill rigs, allowing versatile positioning of an upright mast which supports a drill head which is quickly movable along the length of the mast and enables side to side and forward tilting thereof to accommodate sloping terrain drilling angled holes into the earth.

It is a further object of the invention to provide mobile rigs which can be used to drill deeper holes than conventional mobile rigs by securely stabilizing the rig against tipping motion.

It is another object to provide a mobile drilling rig which can be manufactured and maintained relatively inexpensively and which may be adapted to a great variety of field conditions and uses.

Still another object is to provide a mobile drilling rig which has a retractable seat for an operator which allows good visibility of the components during drilling and movement of the rig between locations where drilling operations are to be conducted.

SUMMARY OF THE INVENTION

The above recited objects of the invention and other objects which will be understood by those skilled in the art are achieved by a mobile drilling rig of a modular construction. A drive chassis, which may be supported and driven by various types of running gear, including wheels, a recirculating track or a snow drive, supports a main frame resting on top of the drive chassis and quickly attached or detached therefrom since only a few fasteners need be removed or installed.

The main frame is made of elongated members fixed together, which may form an X shape, each member having telescoped extensions at one end thereof enabling extending the elongated members for increasing the stability of the main frame.

A vertical support is mounted to an end of each telescoped extension which vertical supports also being extendible to raise or lower the main frame above the ground and the drive chassis.

An elongated mast supporting a drill head is mounted to one end of the main frame on a mast pivot support which allows the mast to be swung from a horizontal position extending back over the main frame, to a vertical drilling position at a location just forward of the main frame.

The mast is also movable on the mast support up and down when vertically oriented or forward and back when in the stowed horizontal position.

The drill head is movable along the length of the mast, preferably by a power cylinder and mechanical movement arrangement which speeds the movement thereof relative to the motion of the power cylinder.

The slide chassis supports a power plant comprised of engine and one or more hydraulic pumps, a fuel tank, a reservoir for hydraulic fluid and other components necessary for powering the various actuators which are hydraulically operated, as well as for propelling of the drive chassis supported on running gear, such as by wheels, a recirculating track or a snow drive.

A self-powered flat bed truck may optionally be used as the drive chassis in which case the power plant is not used to propel the rig but only to operate the various actuators and drill motor The slide chassis is movable on a pair of rails attached to the main frame at the other end thereof from the mast support to be positioned at a variable distance from the other end of the main frame.

The sliding motion of the power plant is useful to facilitate maintenance and/or replacement of the engine and other power plant components, as well as to increase the stability of the rig when being transported as described below.

The main frame may be transported on a wheeled or tracked drive chassis.

As noted, the drill head is powered to be movable in an up and down direction on the mast (and forward and back when the mast is stowed in the horizontal position) by a mechanical movement operated by a double acting power cylinder which has pairs of sprockets on either end thereof, each sprocket in each pair engaged with a respective chain loop passing around a respective set of sprockets. A through cylinder rod of the power cylinder actuator is fixed at either end to the mast. As the cylinder is moved along the mast in either direction when the cylinder is pressurized, the sprockets advance the chain loops a distance substantially greater than the distance of the stroke of the cylinder. The drill head is attached to one segment of each of the chain loops and moves together with those chain segments on guide surfaces on the mast. Another segment of each chain loop is anchored to the mast.

According to an important aspect of the invention the back and forth horizontal movements of the power plant, the mast and the drill head on the mast can be carried out as an aid in maintaining stability when the rig is being driven over up or down sloping terrain by operating the associated actuators.

Any shifting of a center of gravity of the mobile rig caused by being on an up or down grade may also be sensed and the mast/drill head/power plant then shifted horizontally automatically so that any shifting of the center of gravity of the rig is offset by actuating the various associated power cylinders so as to shift the location of these components in the appropriate direction.

That is, when the rig is going downhill, the shifting movements are to the rear, while when the rig is going uphill, movement is to the front to keep the center of gravity as close to the midpoint of the rig as possible.

An operator's seat can be mounted to the rig, swung out from one side of the main frame and shifted forwardly when the rig is going to be operated to allow the operator to operate the various actuators.

DESCRIPTION OF THE DRAWING FIGURES

DETAILED DESCRIPTION

Figure 1:
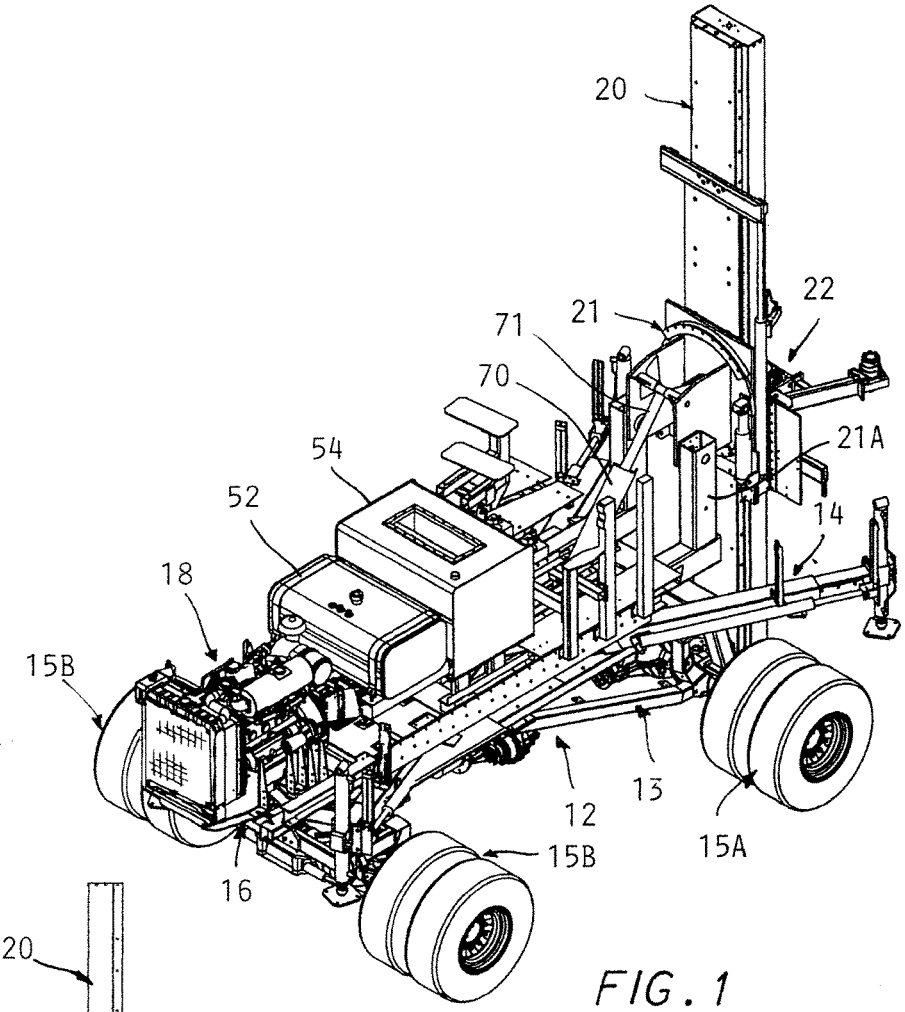
FIG. 1 is a pictorial view of a mobile drilling rig according to the present invention, shown without a cover normally installed over the power plant.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1-5, the mobile drilling rig 10 according to a preferred embodiment of the invention is comprised of four main assemblies which are easily separable from each other for maintenance and servicing or to replace any of these assemblies which requires servicing or with a differently configured version thereof.

These assemblies include a drive chassis 12 of a type which is powered by the power plant 16 described below, which is a steel frame 13 mounting running gear having elements thereof resting on the ground or pavement, here shown as a wheeled drive chassis including four multiple double wheel sets 15A, 15B. The number of wheels in each set is shown as two but may be varied by the insert arrangement shown in the parent U.S. patent application Ser. No. 14/702,853 filed on May 4, 2015, referenced above.

Figure 4:
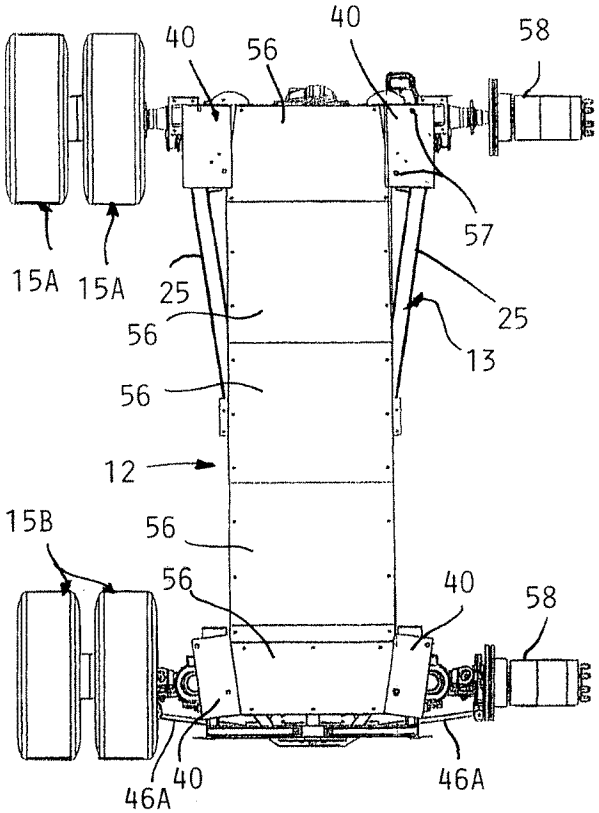
FIG. 4 is a top view of the drive chassis included in the mobile drilling rig shown in FIG. 1.

The drive chassis 12 supports a main frame 14 which is generally configured by crossing members 25 defining a generally X shaped configuration (FIG. 5) and attached to the drive chassis 12 as by eight threaded fasteners (not shown) received in holes in attachment plates 40 (FIG. 4).

Figure 1A:
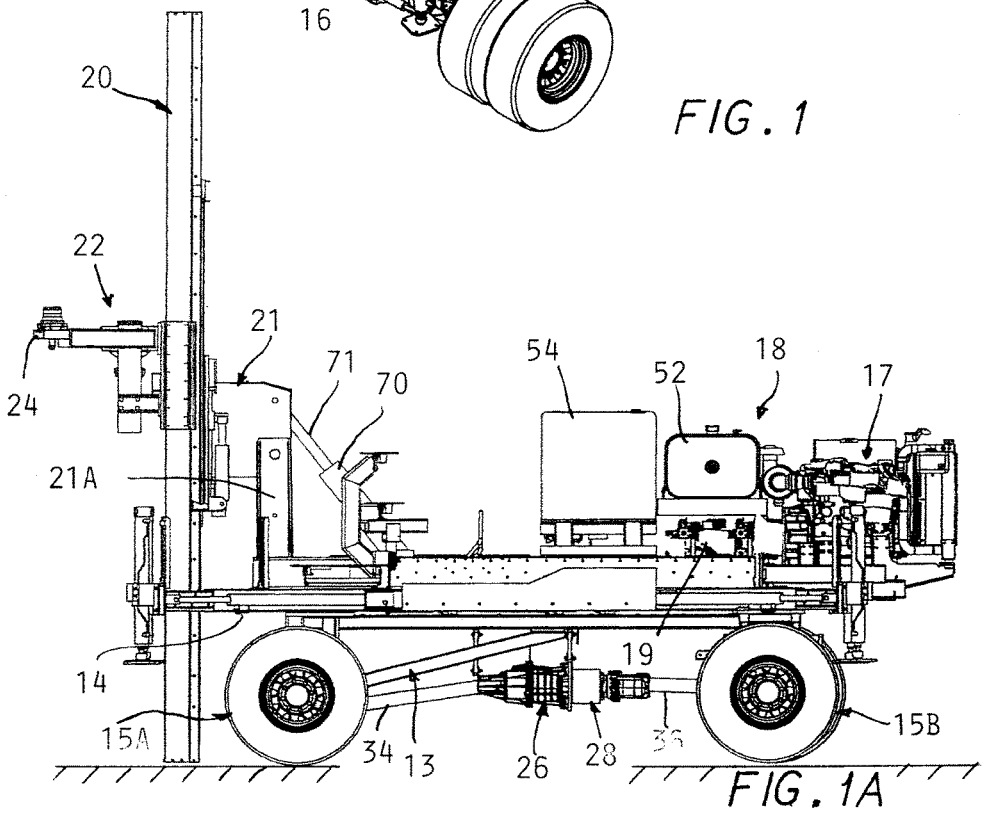
FIG. 1A is a side elevational view of the mobile drilling shown in FIG. 1.

Supported on the left end of the main frame 14 is a slide chassis 16 which in turn mounts a power plant 18 which preferably includes a diesel engine 17 driving one or more hydraulic pumps 19 which provide a source of hydraulic pressure, a fuel tank 52 and hydraulic fluid reservoir 54 (FIG. 1A). The hydraulic power is used for driving the wheels and operating the other hydraulic equipment, mainly the many actuators described herein. The hydraulic lines, not shown, may be routed through a track T shown in broken lines generally rectangular in section to guide the lines when the slide chassis is shifted.

Figure 2:
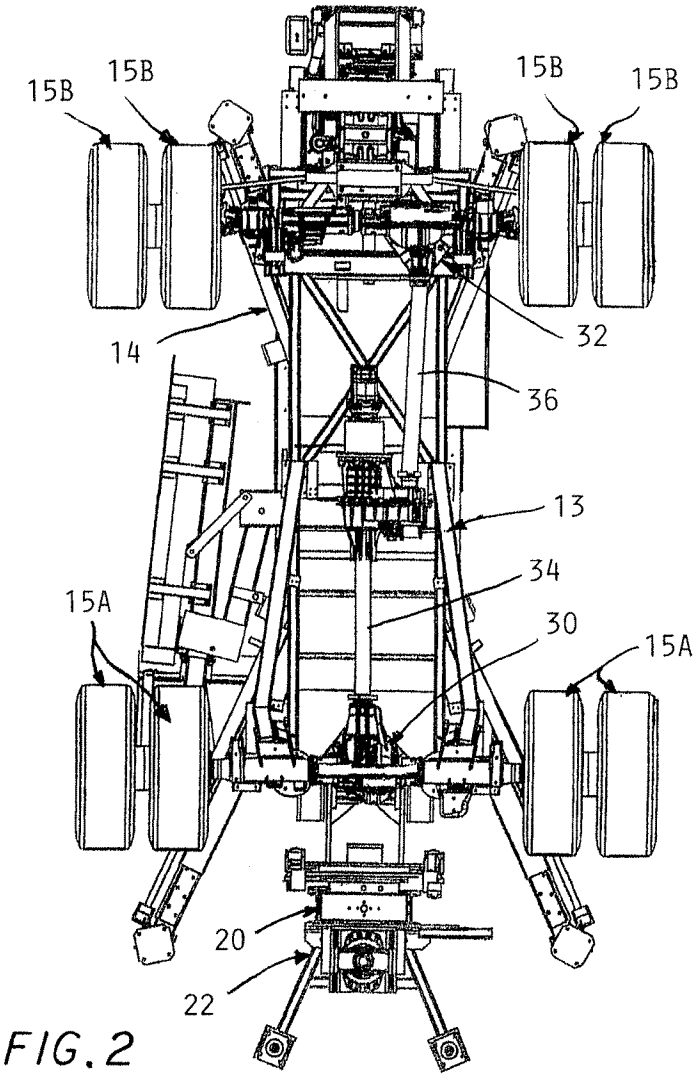
FIG. 2 is a bottom view of the mobile drilling rig shown in FIGS. 1 and 1A.
Figure 3A:
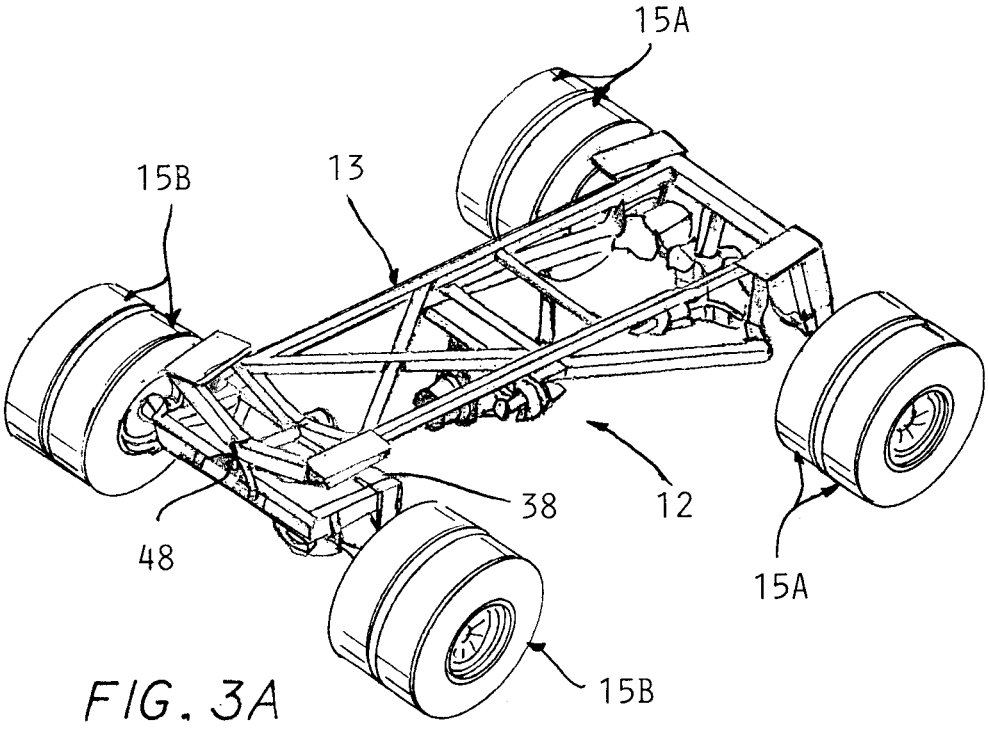
FIG. 3A is a pictorial view of a drive chassis of the mobile drilling rig showing the drive chassis frame without cover plates normally installed thereon for clarity.
Figure 3:
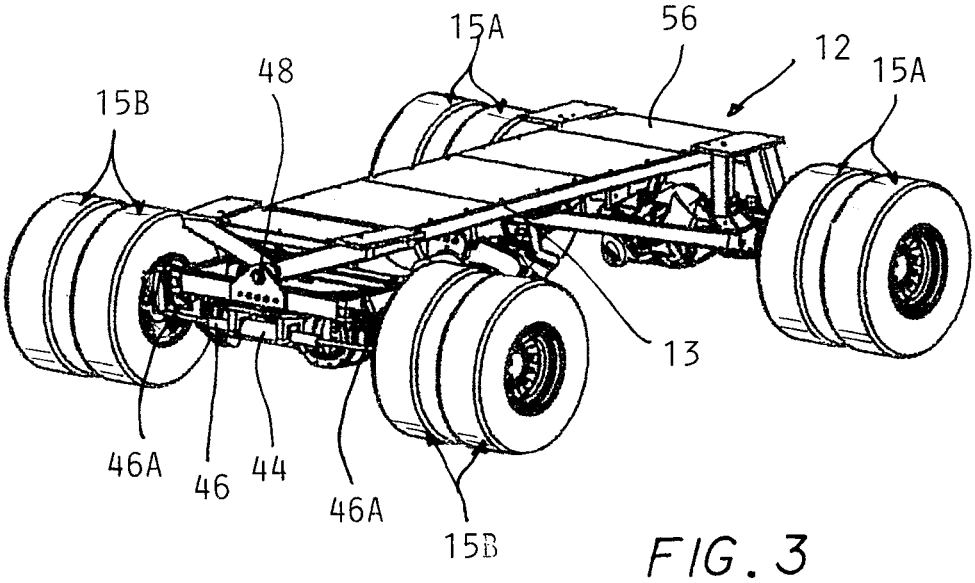
FIG. 3 is a pictorial view of a drive chassis included in the mobile drilling rig as shown in FIGS. 1 and 1A which is powered by the power plant.
Figure 25:
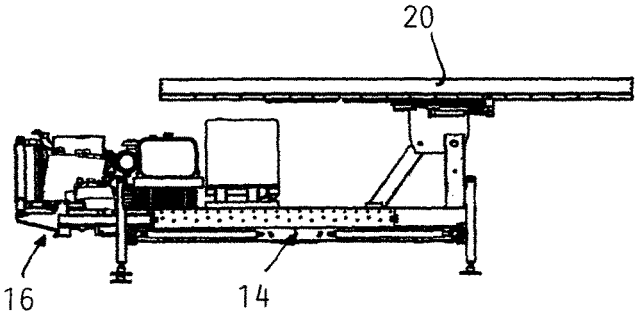
FIG. 25 is a reduced size side view of the slide chassis and main frame with the mast in a horizontal position thereon.

Supported on the right end of the main frame 14 is an elongated mast 20 carrying a drill head 22 movable along the length of the mast 20 when the mast 20 is positioned vertically as seen in the FIGS. 1-3 or horizontally (FIG. 25). The mast 20 is pivotally mounted on a mast pivotal support 21 pivotally connected to a pair of short upright beams 21A fixed on one end of the main frame 14.

The drill head 22 has one or more drill motors 24, each driving a drill (not shown) which is advanced down on the mast 20 as drilling of each bore section proceeds.

It should be noted that many conventional details such as hydraulic lines with supports, wiring, valving etc, are omitted in the drawings for the sake of clarity.

The drive chassis 12 includes a conventional transfer case 26 and hydraulic motor assembly 28 supported beneath the frame 13 which could be comprised of multiple pumps. Conventional front and rear differentials 30, 32 are driven by drive shafts 34, 36 respectively extending from either side of the transfer case 28 (FIG. 2).

Aligned pairs of the wheel sets 15A, 15B are driven by the respective conventional differentials 30, 32.

Front differential 30 and associated axles and wheel sets are supported on a subframe 38 (FIGS. 3 and 3A) able to pivot on one end of the frame 13 by means of a pivot connection 48 thereto.

The front wheel sets 15B are steerable by conventional steering linkages 50 operated by a power cylinder 44 and gear racks 46 and tie bars 47.

Braking is preferably carried out by an internal circuit in the hydraulic motor (not shown) although conventional friction braking by hydraulic actuators could also be employed (not shown).

Four mounting plates 40 are attached to the top of the frame 13 with fasteners (not shown) received in pairs of holes 57 in each plate 40 fixing the main frame 14 in position atop plates 56 covering the frame 13 of the drive chassis 12 (FIG. 4).

The sets of tires 15A, 15B are attached to hubs 58 as described in the parent application referenced above.

Referring to FIGS. 5-10, details of the main frame 14 are shown, which include the elongated members 25 which are welded together in a general X form, crossing at the center.

Connecting beams 60, 62 reinforce the right end and support a pair of upright posts 21A that hold the mast pivot support 21 for the mast 20.

Bearing plates 64 having holes 65 at the top of upright posts 21A are provided for a generally U shaped structure 66 included in the mast pivot support 21 as further described hereinafter.

Bearing blocks 68 are fixed to cross beam 60 for mounting a large power cylinder 70 (FIG. 1) used to pivot the structure 66 as described below.

Figure 10:
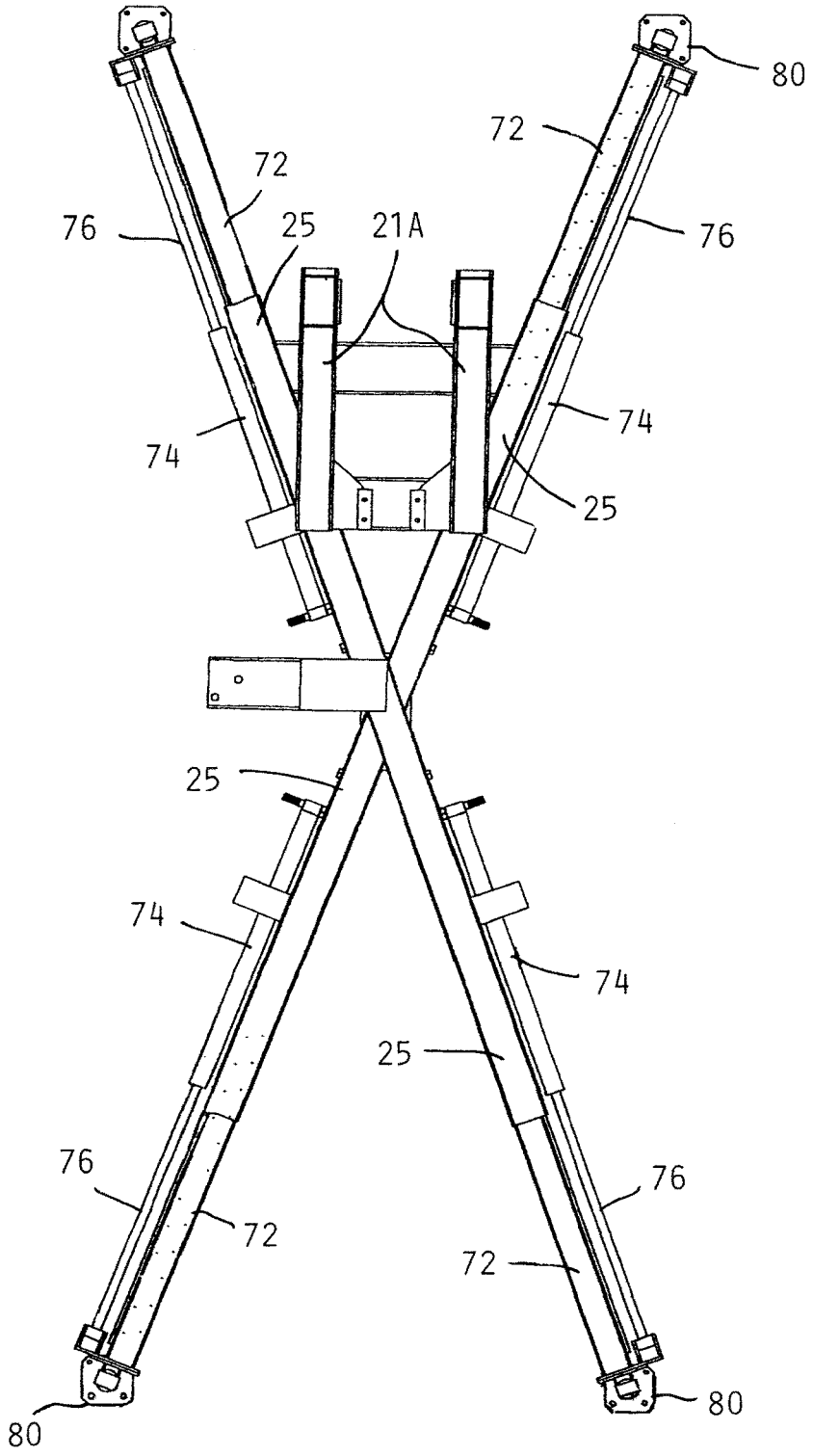
FIG. 10 is a plan view of the main frame with the horizontal extensions fully moved out.
Figure 11:
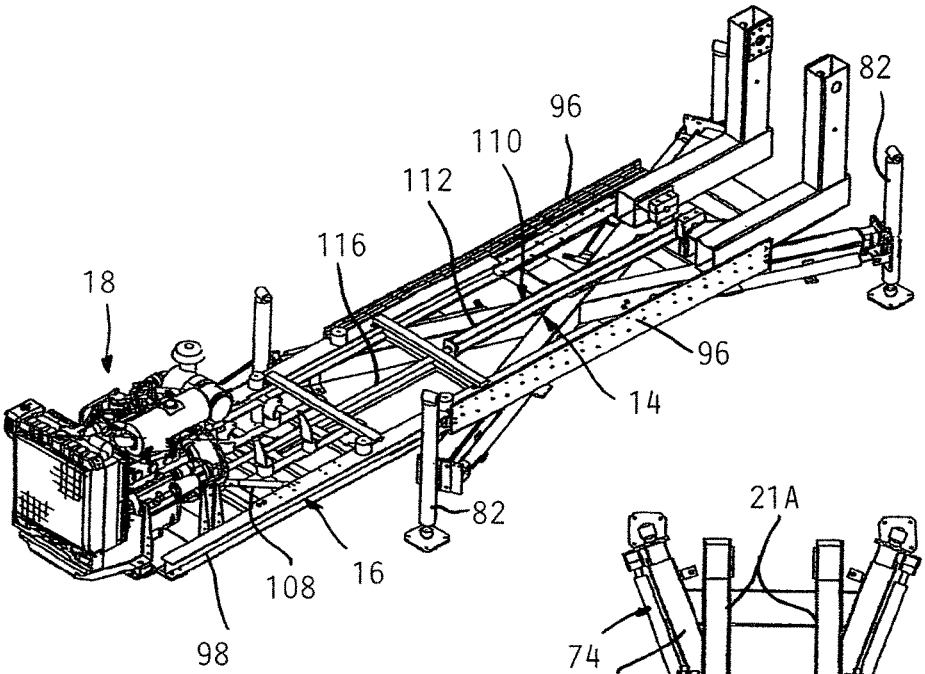
FIG. 11 is a pictorial top view of a slide chassis mounted to the main frame fully extended therefrom with supported thereon components removed for clarity.
Figure 12:
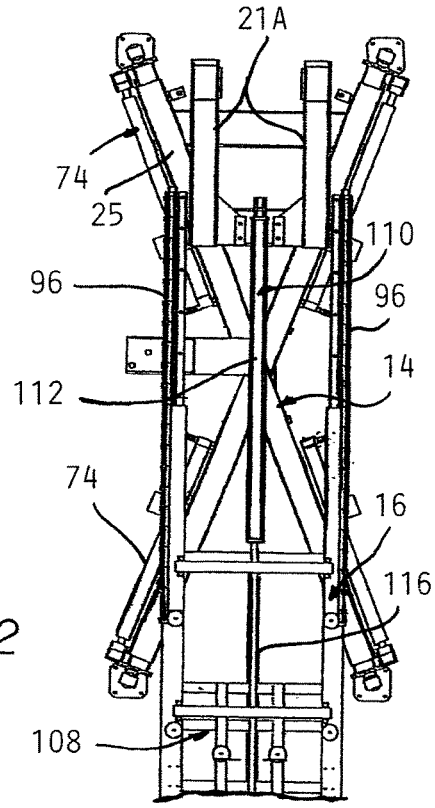
FIG. 12 is a fragmentary top view of a slide chassis fully extended from the main frame.
Figure 13:
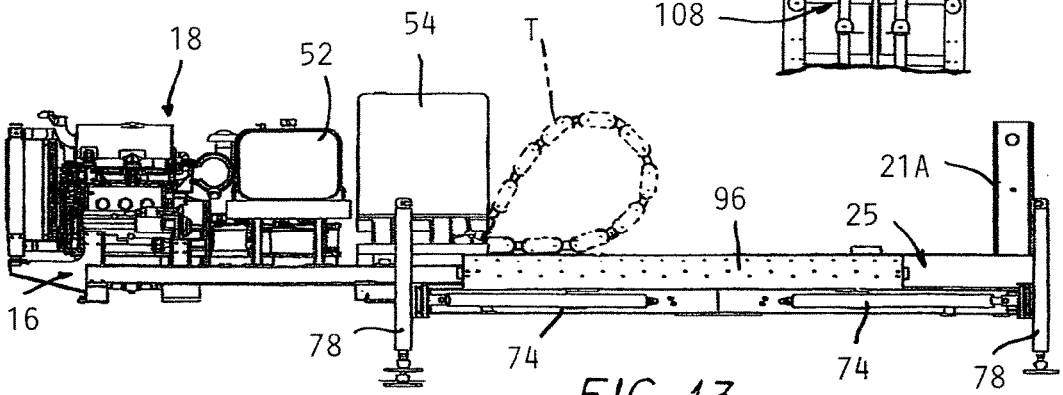
FIG. 13 is a side elevational view of a slide chassis fully extended from the main frame with all of the major components shown in place and a hydraulic hose guide rack shown in phantom lines.

Each member 25 has an extension 72 telescoped therein at its outer end connected to a hydraulic double acting actuator cylinder 74 output rod 76 which can be selectively activated to move the extension 72 outwardly to increase the effective length of the members 25 for increased stability to resist reactions to the drilling operations as necessary as shown in FIG. 10.

Figure 9:
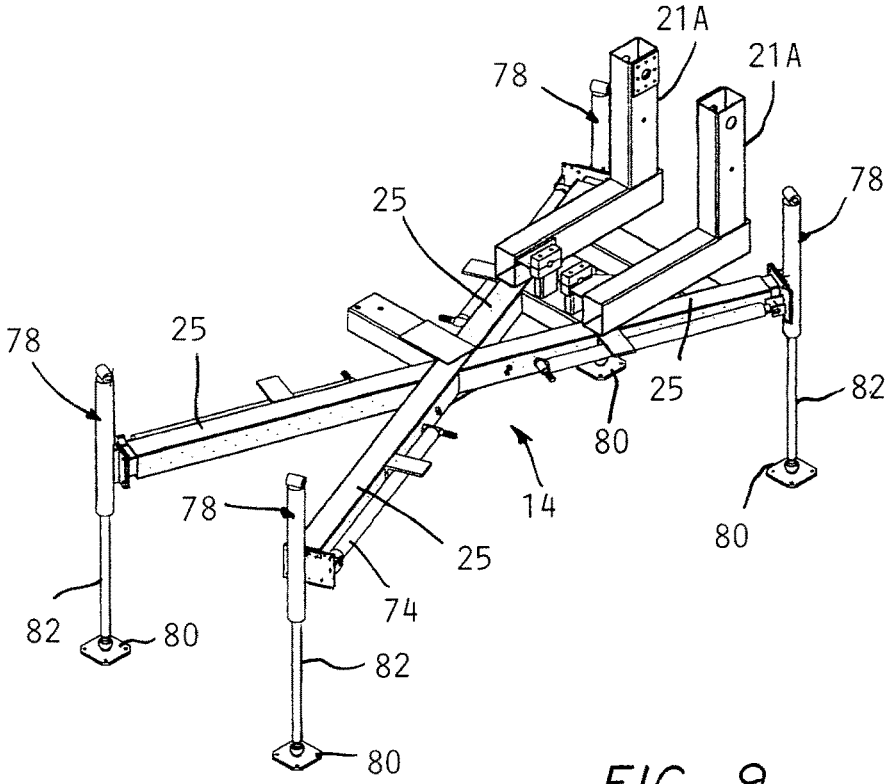
FIG. 9 is a pictorial view of the main frame as shown in FIG. 8 with the vertical end supports fully extended.

Each extension 72 has an adjustable height stanchion mounted thereto, comprised of a vertically mounted power cylinder 78 with a foot plate 80 attached to an output rod 82 to allow tilting to securely rest on the ground. As seen in FIG. 9, the rods 82 can be extended vertically to selectively raise the main frame 14 when drilling or to replace or service the drive chassis 12 as with a track drive.

Hydraulic hose guide tracks 85 can be provided to control movement of the hydraulic hoses (not shown) as the extensions 72 move in and out in the well known manner, with track holder pieces 86, 87 affixed to members 74 and extensions 72 respectively for that purpose.

Figure 6:
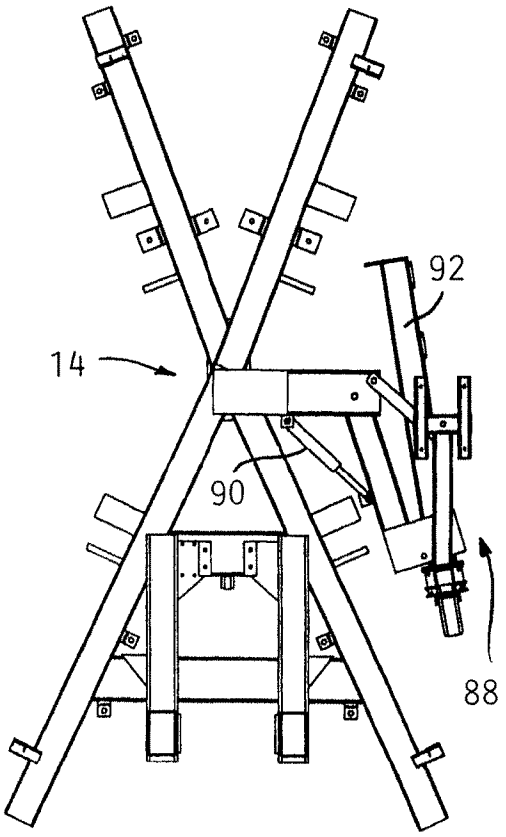
FIG. 6 is a reduced size top view of the main frame shown in FIG. 5 with the structural support members for an operator seat depicted in a retracted state.
Figure 7:
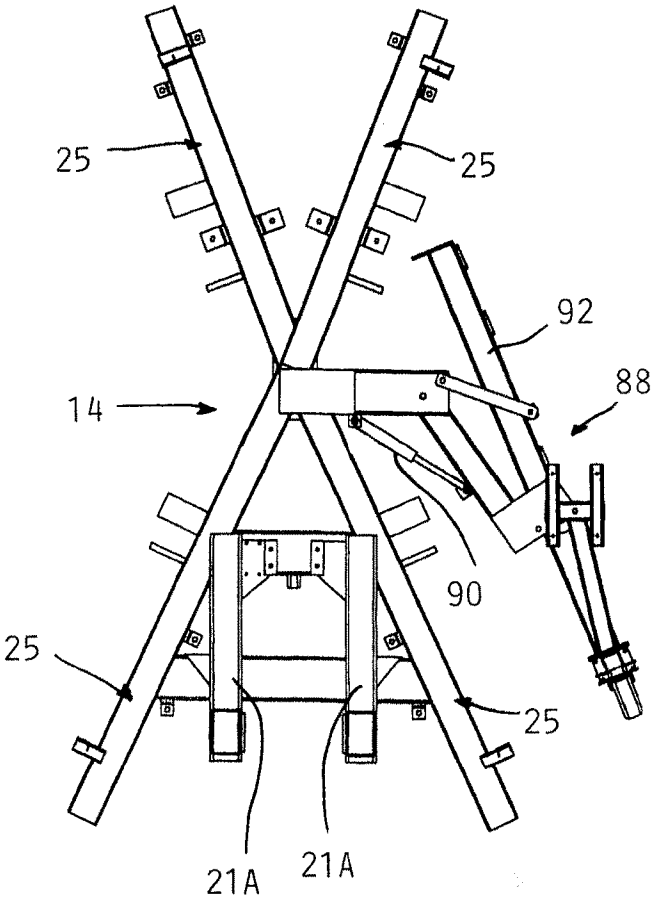
FIG. 7 is a top view of the main frame as shown in FIG. 6 but with the operator seat structural support members for an operator seat swung out and extended.
Figure 8:
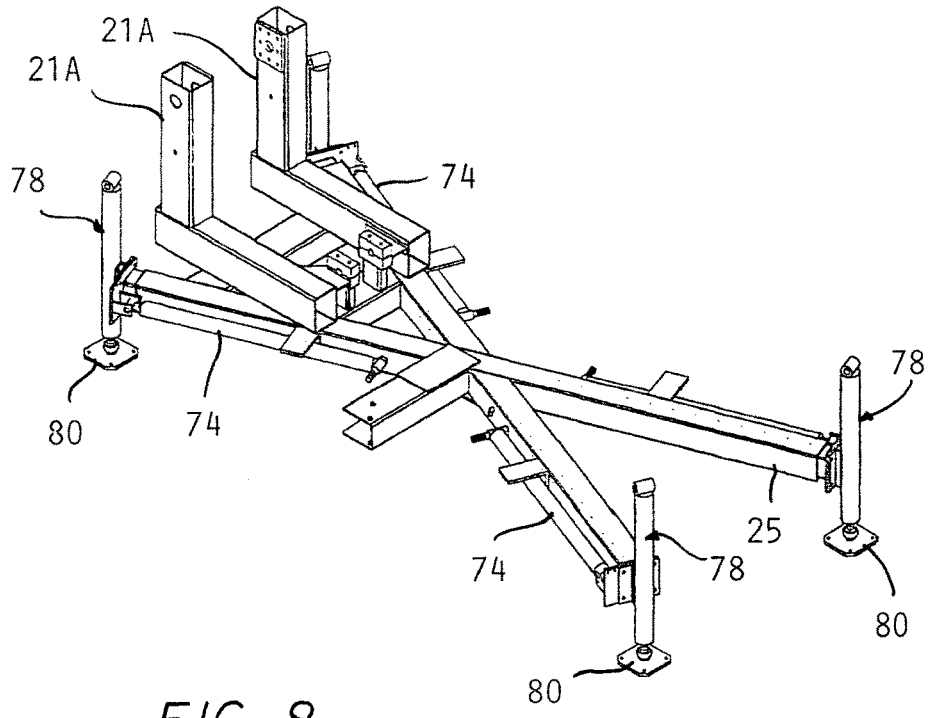
FIG. 8 is a reduced size pictorial view of the main frame shown in FIG. 5 without the operator seat structural support members, with both the vertical end supports and horizontal extensions in retracted positions.

The main frame 14 also includes a seat swing out linkage 88 on one member 25 operated by a power cylinder 90 and slide 92 which swings a seat support structure 94 outwardly and forwardly as seen in FIGS. 6 and 7. This portions an operator to have good vision of the movable components including driving of the rig and drilling operations.

FIGS. 11-15 show details of the mounting and movement of the slide chassis 16 atop the main frame 14.

A pair of parallel slide channels 96 are affixed to main frame members 25 and slidably receive a pair of slide chassis members 98 with interposed antifriction layers 100 around box beams 102 and channels 96.

Figure 14A:
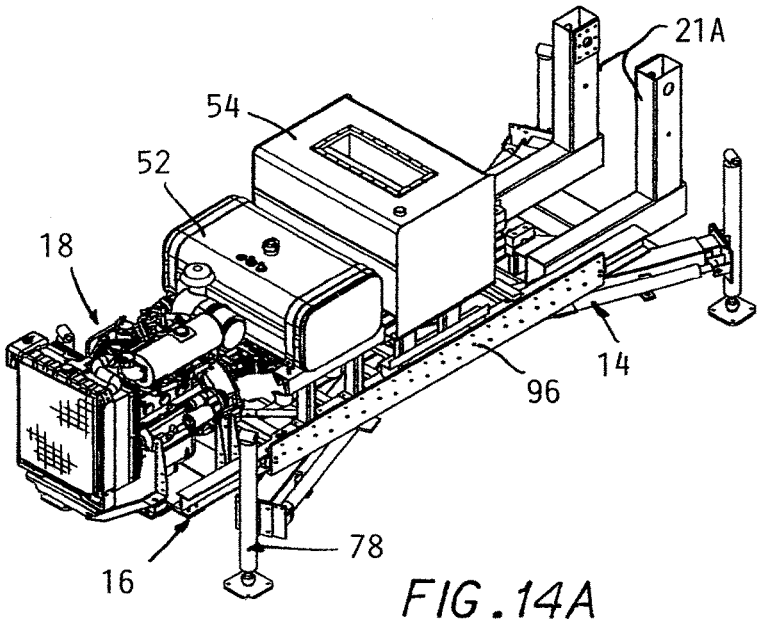
FIG. 14A is a pictorial view of the slide chassis shown in a fully retracted position on the main frame.
Figure 14:
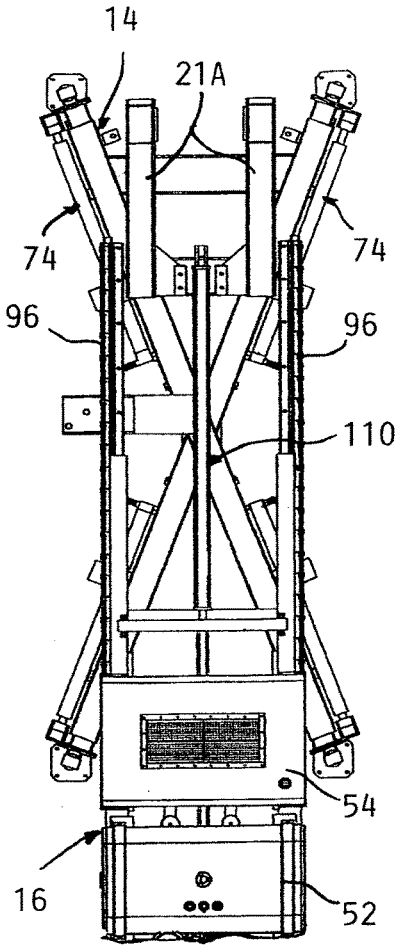
FIG. 14 is a fragmentary top view of the slide chassis fully extended from the main frame and the supported components omitted in FIG. 11 shown in place.
Figure 14B:
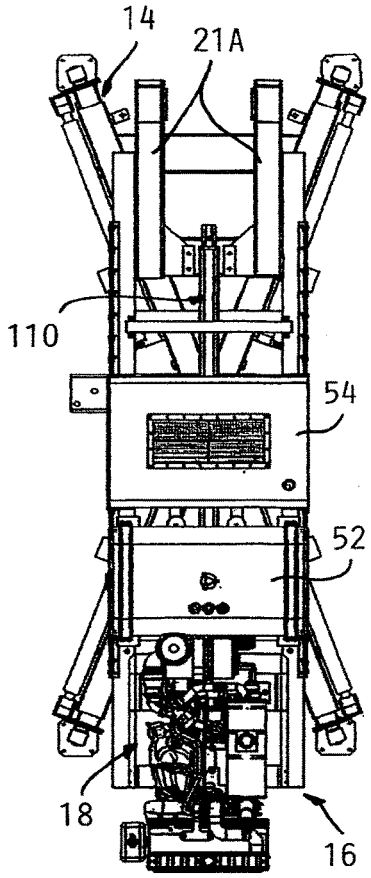
FIG. 14B is a top view of the slide chassis in the fully retracted position on the main frame.
Figure 15:
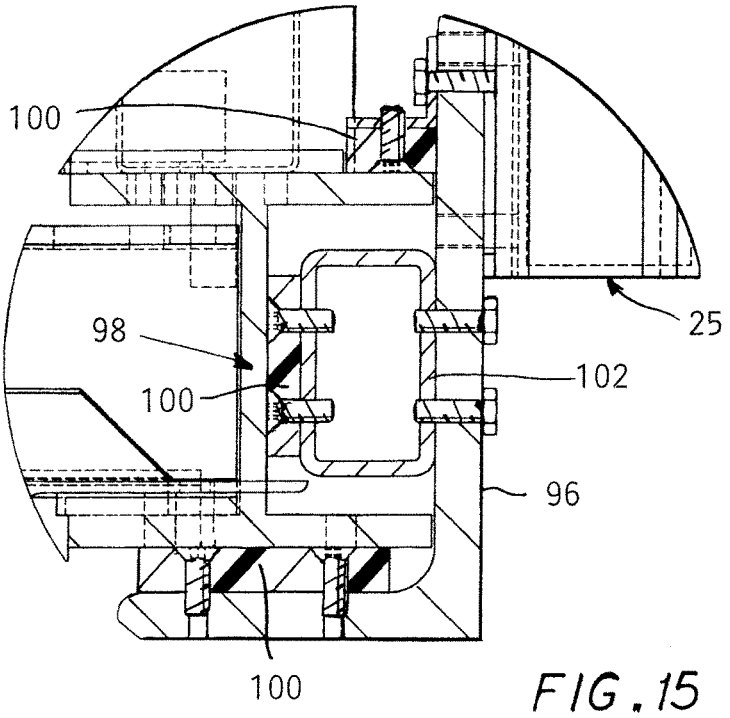
FIG. 15 is an enlarged fragmentary partially sectional view of the mating rail components for the slide chassis.
Figure 17:
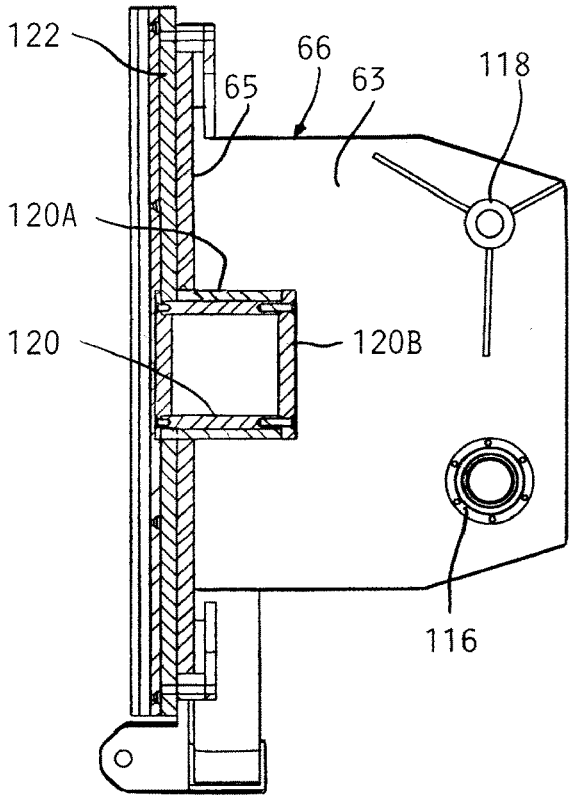
FIG. 17 is a view of the section A-A in FIG. 16.

An array of cross pieces 104, 106, 108 fixed extending between members 98 provide support for the power plant 18, the fuel tank 52 and 54. A large hydraulic cylinder 110 extends lengthwise above the main frame 14, the cylinder body 112 fixed at the end thereof to the main frame 14, with an output rod 114 connected to the chassis 16. This enables the sliding chassis 16 to be pushed to the extended position shown in FIGS. 11-14 (or to be removed entirely) or moved to a fully retracted position shown in FIGS. 14A, 14B.

This makes servicing including installation and replacement of the power plant components much simpler and quicker.

In addition, this shifting action is used to increase the stability of the rig when going up or down grades as will be described in further detail below.

Referring to FIGS. 16-23, the details of the slidable mounting of the mast 20 to the mast pivot support 21 can be seen.

The mast pivot support structure 66 includes a pair of plates 63 welded to a pivot connector plate 65 which is secured to the main frame 14, by being pivotally connected to the upright members 21A at one end of the main frame 14 (FIG. 1).

Figure 5:
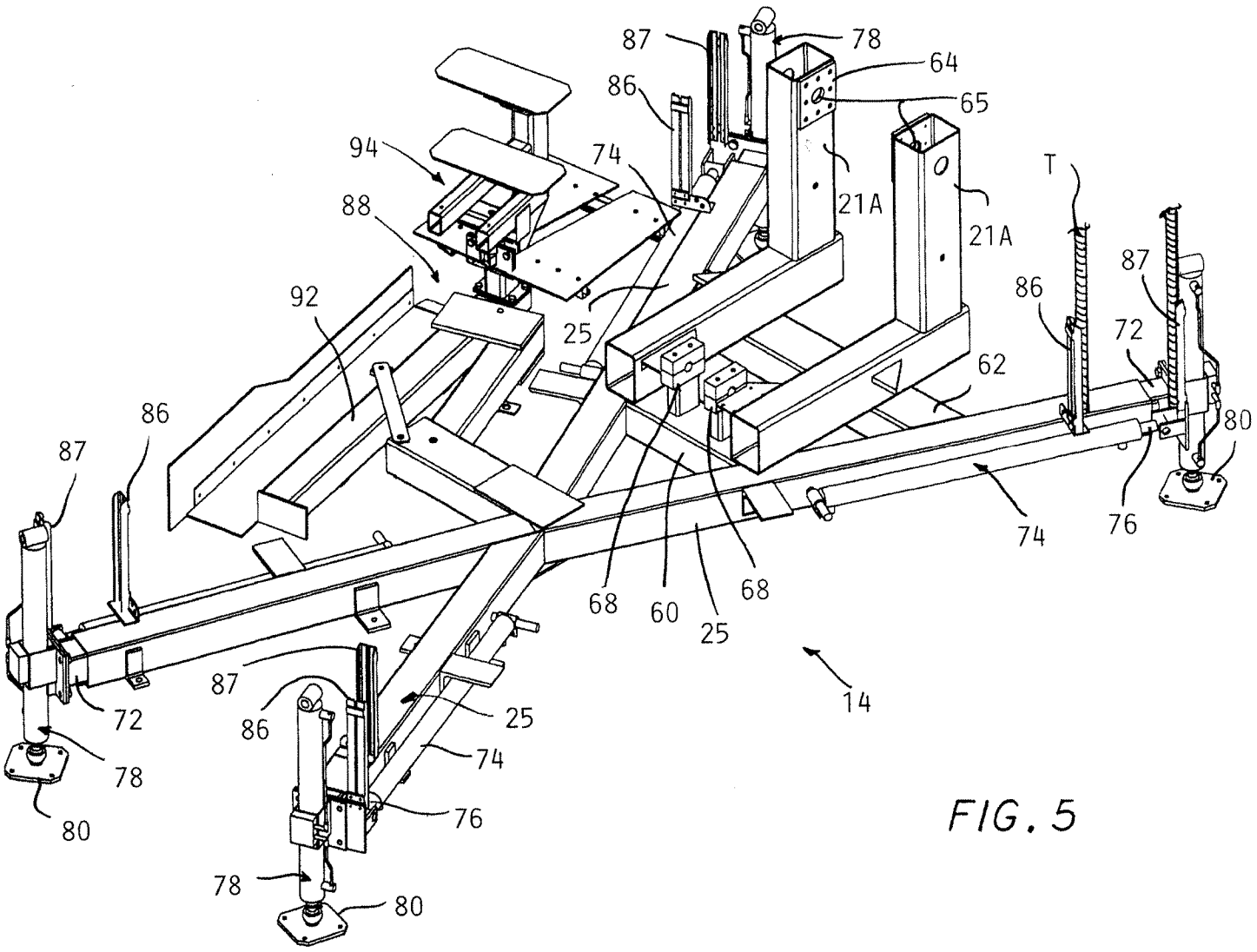
FIG. 5 is a pictorial view of the main frame included in the mobile drilling rig shown in FIG. 1.

The bosses 116 on each side plate 63 are received in holes 65 in plates 64 at the upper end of the upright members 21A fixed to the main frame 14 (FIG. 5).

The power cylinder 70 output rod 71 (FIG. 1) has the ends of a connector shaft 73 received in respective tubular holders 118 to allow pivoting of the pivot support structure 66 when the power cylinder 70 is actuated as illustrated in FIGS. 24-27 to swing the mast 20 about a horizontal axis extending side to side defined by the bosses 116 from a vertical (or slightly past vertical) portion to a horizontal position extending back over the main frame 14 and slide chassis 16.

Figure 16:
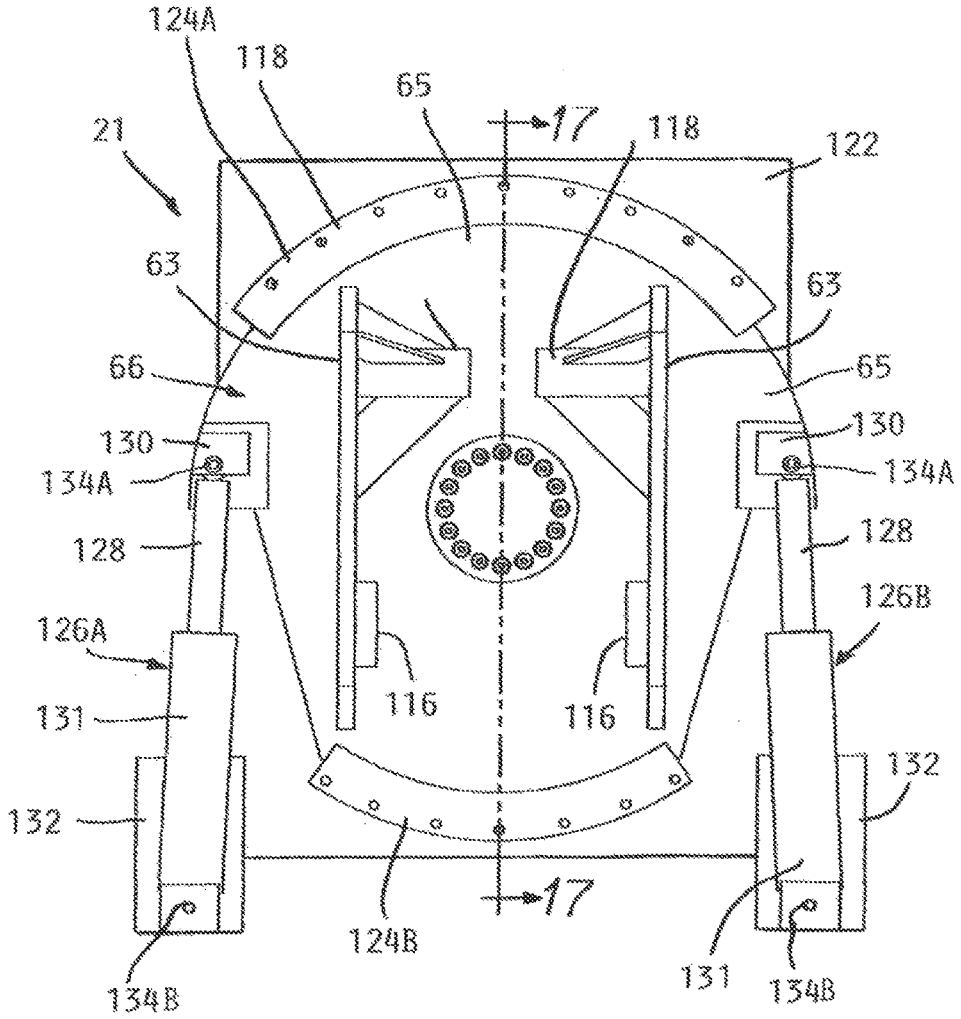
FIG. 16 is a front view of the mast pivot support included in the drilling rig of FIG. 1.
Figure 16A:
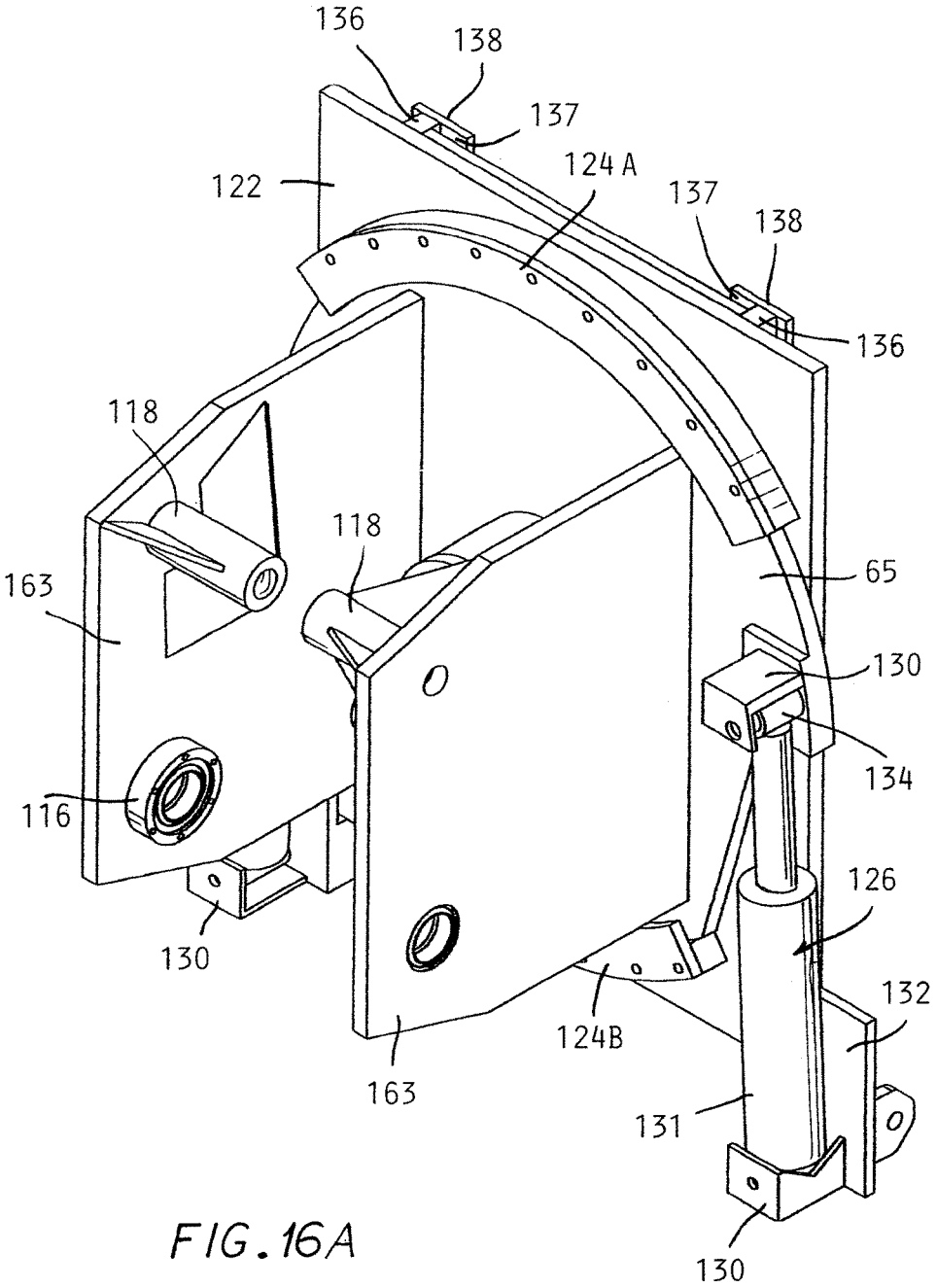
FIG. 16A is an enlarged pictorial view from the front of the mast pivot support shown in FIG. 16.

The plates 63 and pivot plate 65 affixed thereto cannot rotate since mounted to the frame members 21 by a connection allowing pivoting of the mast pivot support 66 to the front or rear about a horizontal axis (FIGS. 16, 16A) but preventing motion to the sides thereof as viewed in FIG. 16.

The fixed plate 65 has a hole formed therein which allows a rotary cylinder 120 affixed to a pivot back plate 122 to protrude into the space between the side plates 63. The rotary cylinder 120 allows the pivot back plate 122 to rotate about a horizontal axis extending longitudinally with respect to the main frame 14 to either side on fixed plate 65. An outer tube 120A fixed to plate 65 and end cap 120B encloses the rotary tube 120.

A pair of radiused cover pieces 124A, 124B are affixed to pivot back plate 122 and extend over upper and lower edges of the fixed connector plate 65.

A pair of power cylinders 126A, 126B each have an output rod 128 connected with an attachment 130 at its upper end to a respective side of the fixed connector plate 65 with a pivot 130A (FIG. 16).

The lower end of each cylinder body 131 is attached to a respective side of the pivot plate 122 by mounting extension mounting plates 132 and pivots 134B.

The pivot back plate 122 has a pair of square sheets 136 (FIG. 16A) made of a friction reducing material fixed to the backside thereof, with a pair of mast retention plates 138 attached over the spacers 136. This creates a pair of spaces 137 for slidably receiving the ends of a mast back plate 142.

A flat spacer sheet 140 of friction reducing material is interposed between the mast back plate 142 and the pivot back plate 122.

Figure 18:
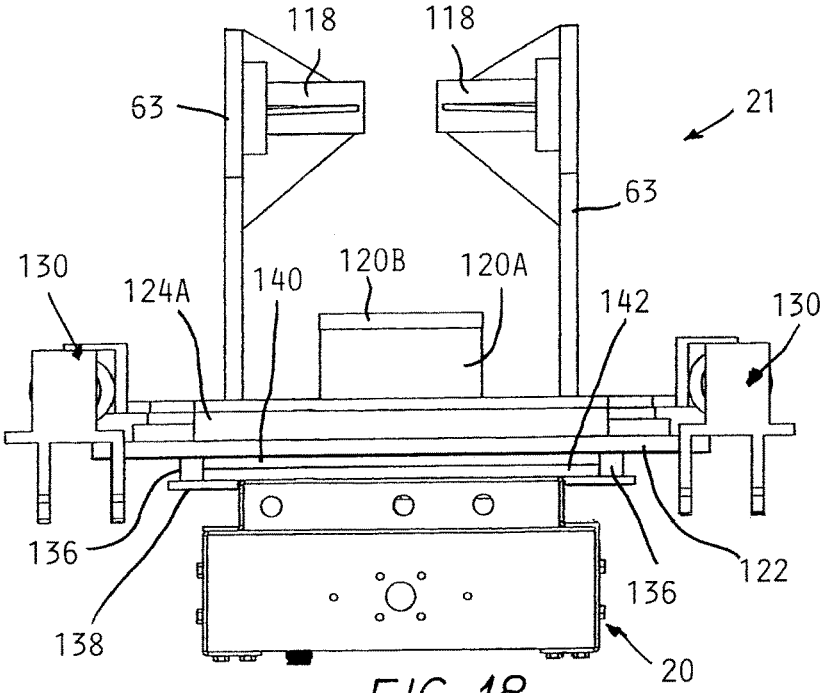
FIG. 18 is a reduced top view of the mast pivot support with the mast in place thereon in a vertical orientation.
Figure 19:
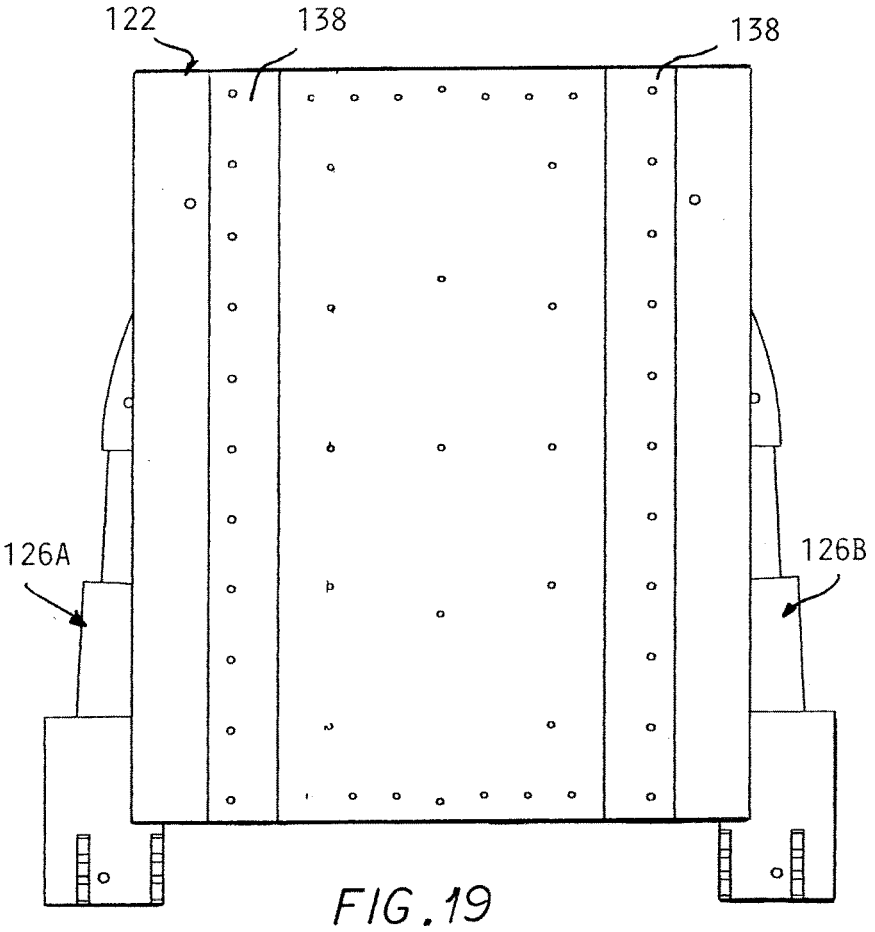
FIG. 19 is an end rear view of the back plate of the mast pivot support with the antifriction coverings installed thereon.

Thus, as seen in FIG. 18, the mast 20 is slidably mounted to the pivot support 21 enabling guided vertical or horizontal movement of the mast 20 depending on the orientation of the mast 20 about its pivot axis. At the same time this makes the mast 20 rotate with the pivot back plate 122, enabling limited tipping of the mast 20 sideways in either direction.

Figure 20:
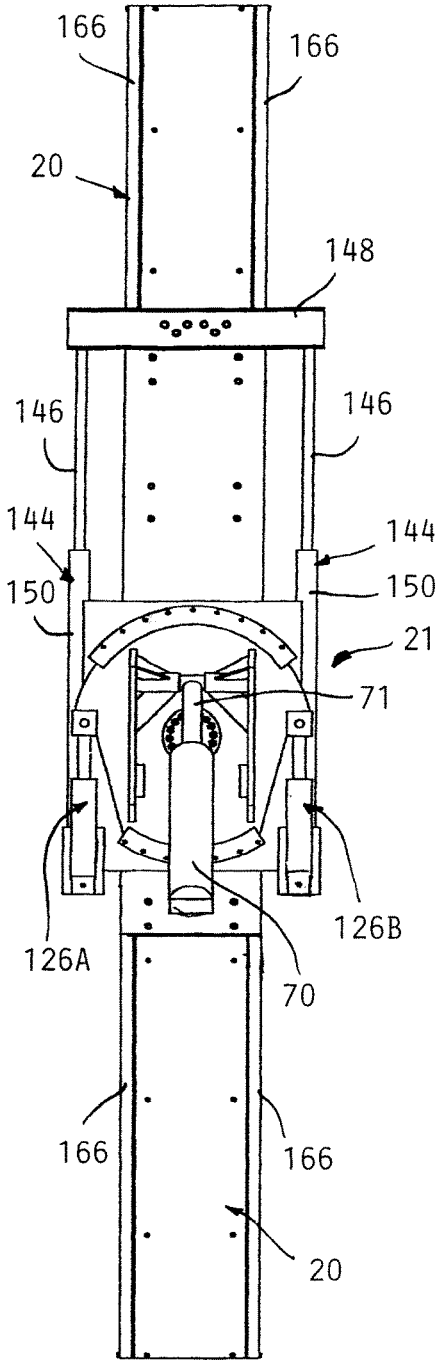
FIG. 20 is a front view of the pivot support and mast.
Figure 21:
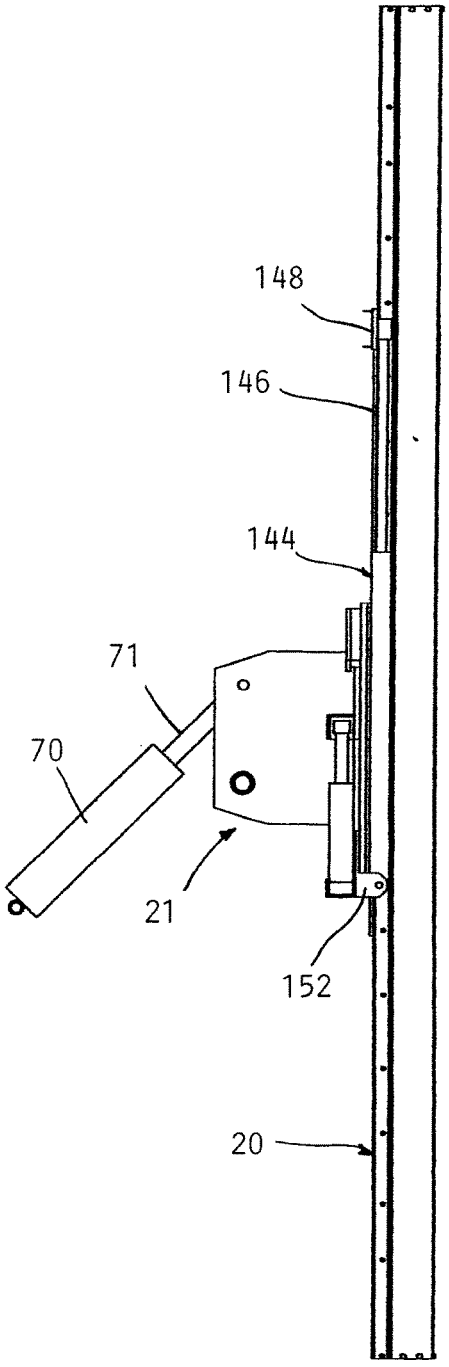
FIG. 21 is a side view of the pivot support and mast as shown in FIG. 20.
Figure 22:
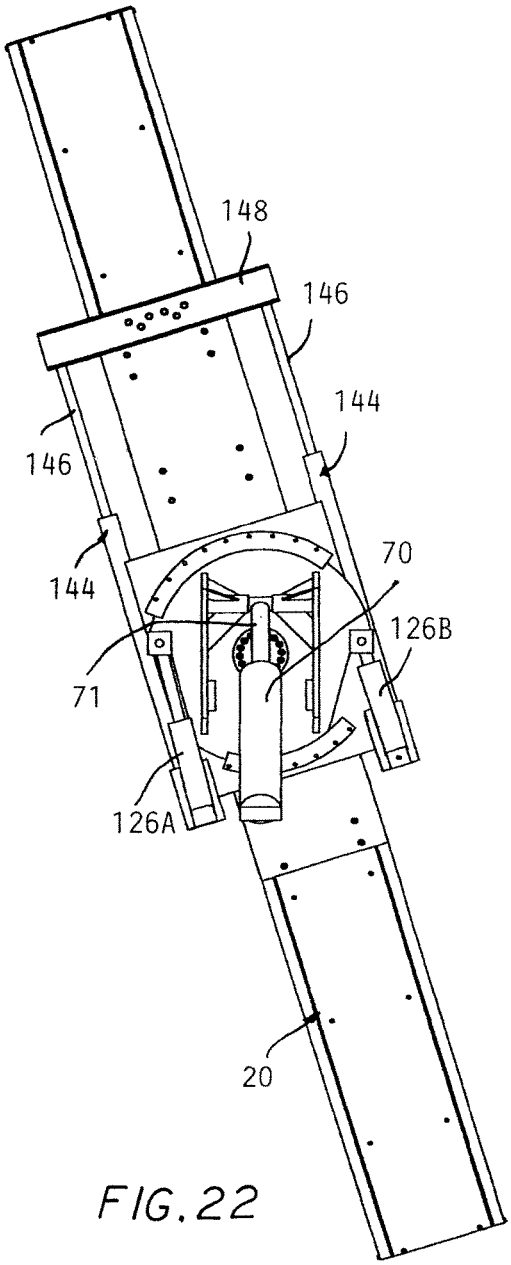
FIG. 22 is a front view of the pivot support and mast as shown in FIG. 20 with the mast tilted to the left.
Figure 23:
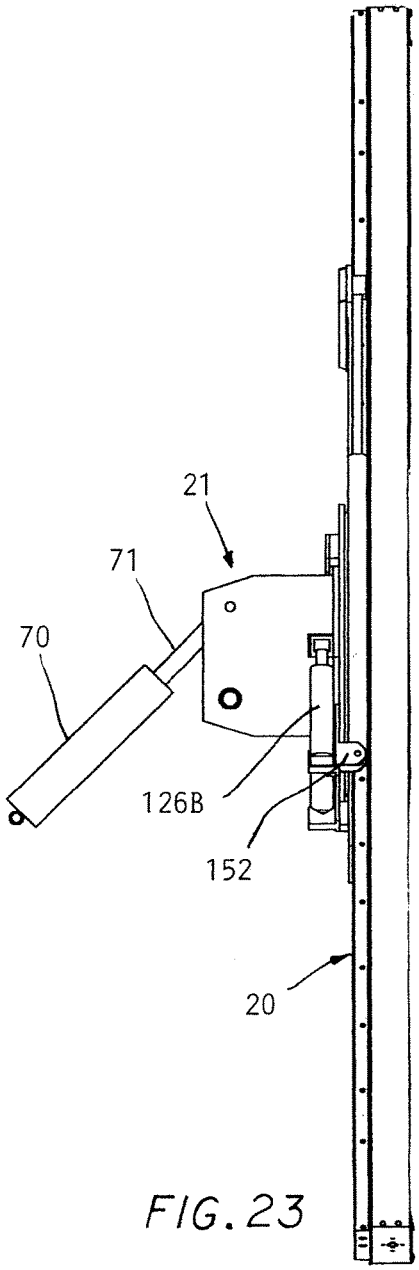
FIG. 23 is a side view of the pivot support and mast as shown in Figure.
Figure 28:
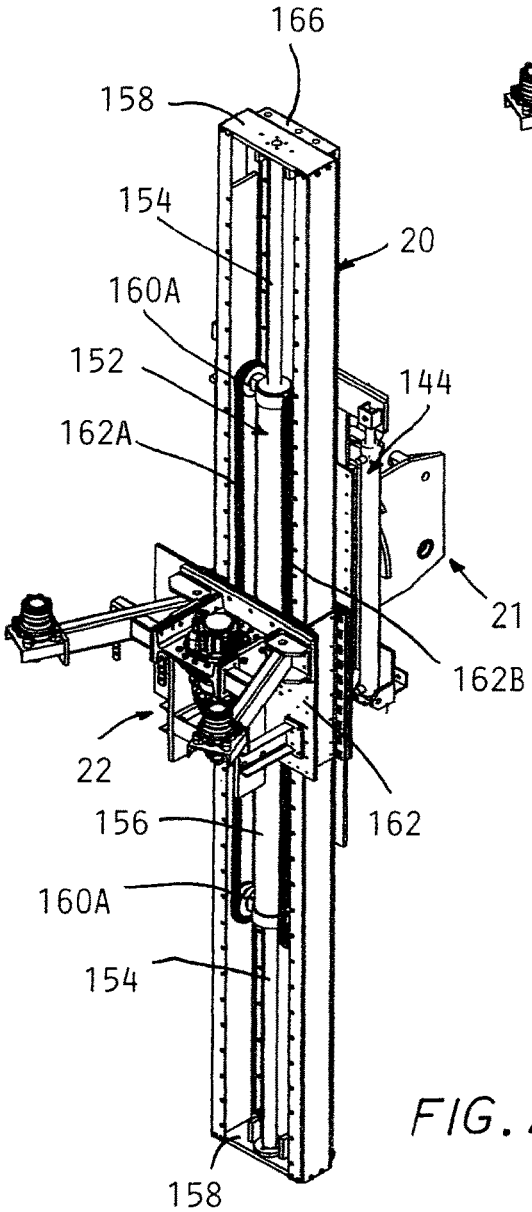
FIG. 28 is a pictorial rear view of the mast pivot support, mast and drill head with the mast elevated on the mast pivot support.
Figure 29:
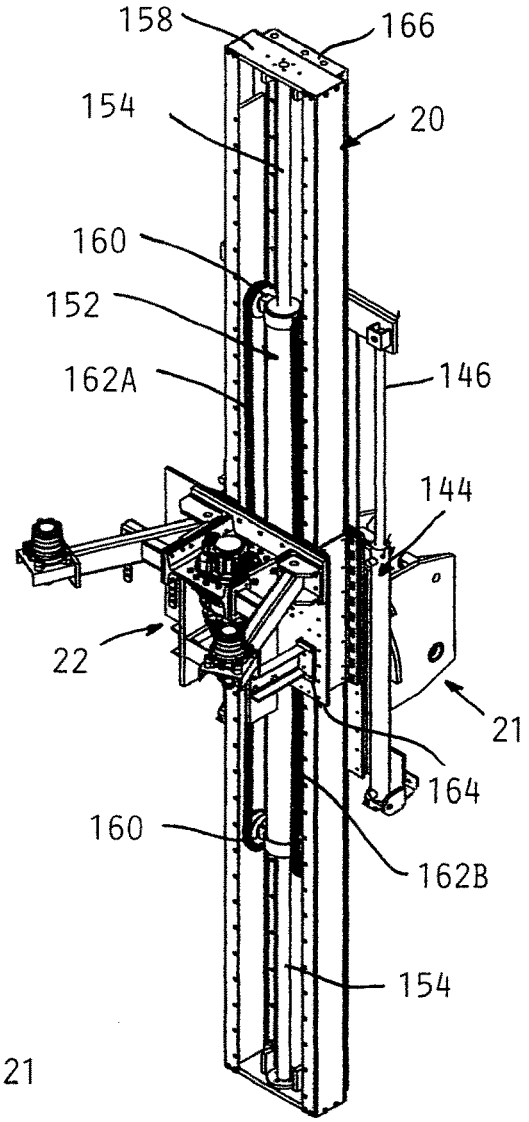
FIG. 29 is a pictorial rear view of the mast pivot support, mast and drill head with the mast in a lowered position on the pivot support.

A pair of long power cylinders 144, best seen in FIGS. 20 and 22 but also in FIGS. 21, 28 and 29 have an output rod 146 attached to a cross bar 148 affixed to the mast 20 and a body 150 attached by a pivot support 152 (FIGS. 21 and 23) to the mast pivot support 21 to slide the mast 20 up or down (or back and forth) relative to the mast pivot support 21.

The double acting power cylinders 126A, 126B are oppositely actuated as seen in FIG. 22 to enable tilting of the mast 20 in either direction sideways to the left shown in FIG. 22. The power cylinders 126A, 126B prevent tilting when not actuated.

Figure 24:
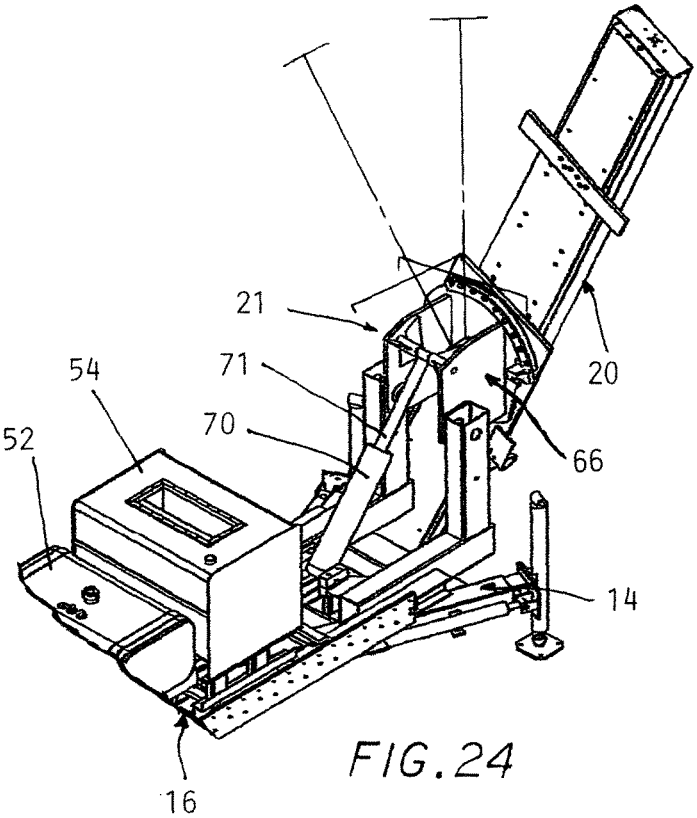
FIG. 24 is a reduced size fragmentary pictorial view of a portion of the slide chassis and main frame with the mast and pivot support shown in the fully tilted right position.

Tilting to the right is shown in FIG. 24.

Figure 26:
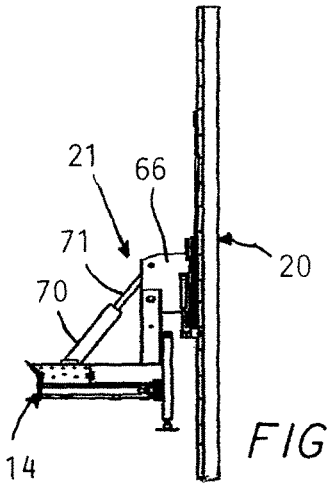
FIG. 26 is a fragmentary depiction of the main frame with the pivot support and mast in a vertical position thereon.

As seen in FIGS. 25 and 26, the mast 20 can be positioned in either a horizontal or vertical orientation while having an ability to be moved in a lengthwise direction either horizontally or vertically.

Figure 27:
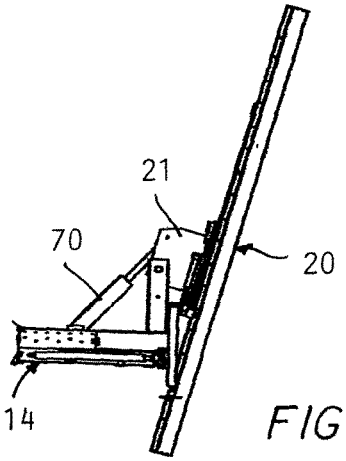
FIG. 27 is a fragmentary depiction of the main frame with the mast and pivot support in the past vertical tipped position.

The mast 20 may be tipped past vertical to a limited extent, as seen in FIG. 27.

FIGS. 28-32 show details of the mounting of the drill head 22 on the mast 20 which allows advancing and retracting movement thereof along the length of the mast 20. A mechanical movement is included to enable advance of the drill head 22 at a rate of speed double that of the actuator motion.

A double acting power cylinder 152 is mounted within the mast 20 and has an output rod 154 protruding from either end of the cylinder body 156, each end anchored to an end wall 158 of the mast 20. The cylinder body 156 is moved lengthwise within the mast 20 in either direction by proper application of hydraulic pressure to the double acting cylinder 152 in the well known manner.

At each end of the cylinder body 156, a pair of rotatable sprockets 160 are mounted rotatable about a common axis normal to the direction of movement of the cylinder body 56.

It is noted that only one of the two sprockets 160 on each end of the cylinder body 156 is visible in FIGS. 28, 29.

A respective chain loop 162A, 162B extends around each sprocket in positive driving engagement therewith so that there are two segments 168A, 168B of each chain loop extending between each of the respective engaged sprockets.

The triple drill head 22 details do not form a part of the present invention and are here described to illustrate that the drilling rig 10 of the invention is useable not only with a single head but also with various types of drill designs and drill holders and drivers.

A base plate 164 may be provided mounting together the components of the drill head 22 and riding along the side of the mast 20.

A pair of I beam guide members 166A, 166B are affixed beneath the plate 162, with webs engaging and being captured by a step 166 feature on each side of the mast 20. Antifriction coverings are preferably provided to minimize friction between the mating surfaces as the drill head 22 moves along the length of the mast 20.

Figure 30:
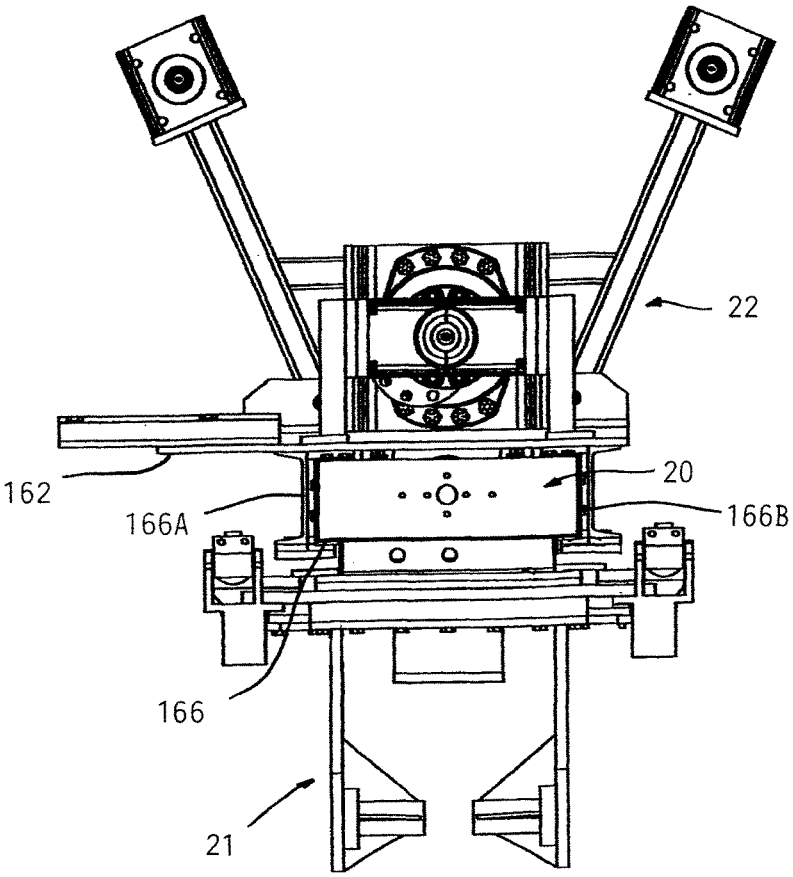
FIG. 30 is a top view of the mast pivot support, the mast, and the drill head.

As seen in the diagram of FIG. 30, the upper chain segment 168A is attached to the drill head 22 with a connector 170 so that the drill head 22 moves with upper chain segment 168A when the cylinder body 156 moves in either direction upon pressurizing one of the sides of the piston (not visible) within the cylinder body 156.

The lower chain segment 168B is fixed at one point to relatively stationary structure by a connector 172.

This causes the upper chain segment 168A to be moved more rapidly than the cylinder body 156 but in the same direction.

Figure 32:
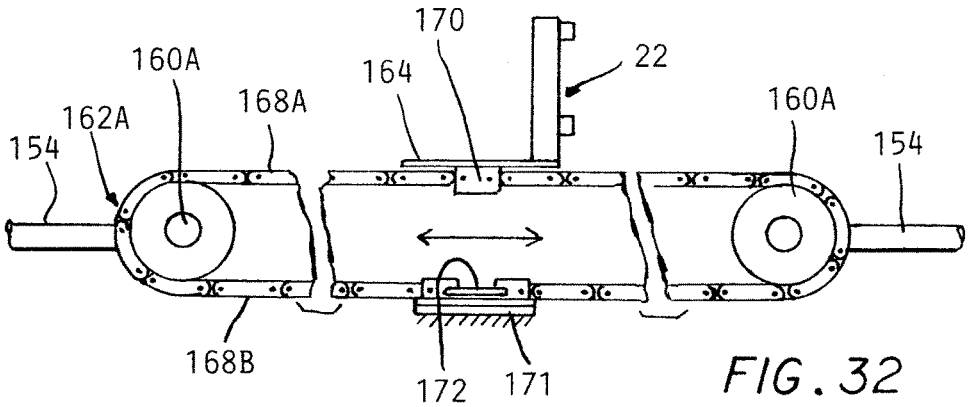
FIG. 32 is an enlarged diagrammatic representation of the drill head and mast depicting the drive arrangement shown in FIG. 31.
Figure 33:
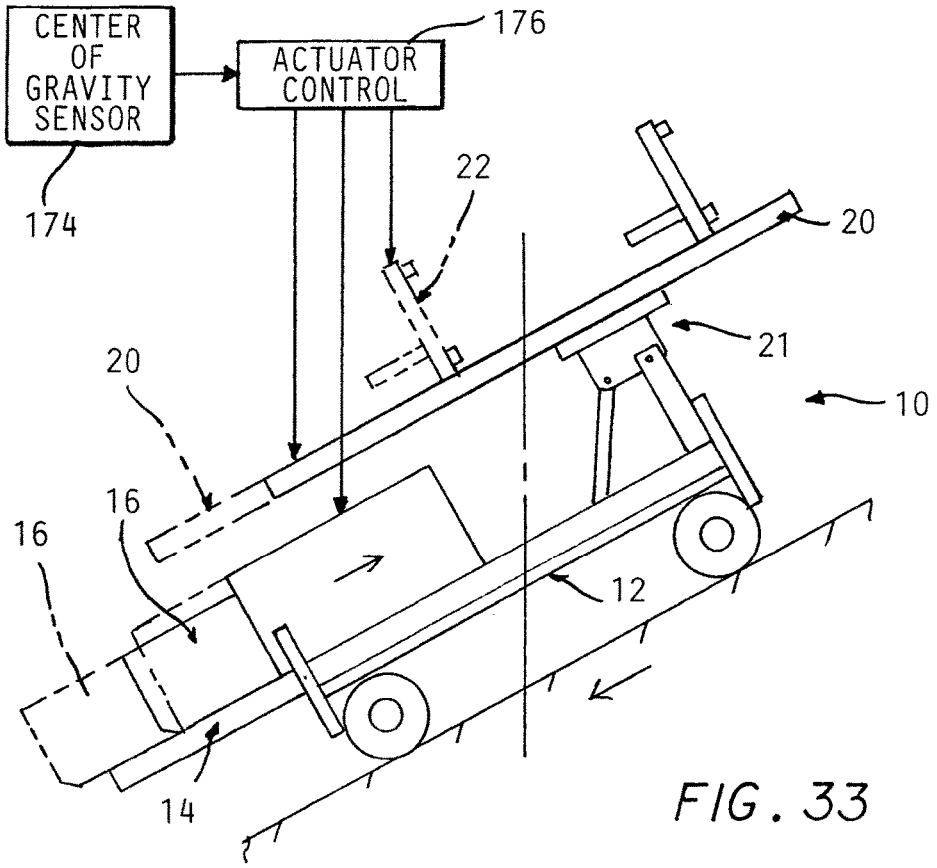
FIG. 33 is a diagrammatic representation of a mobile drill rig according to the invention descending a grade with movable components shifted to increase the stability of the rig when descending a grade.
Figure 34:
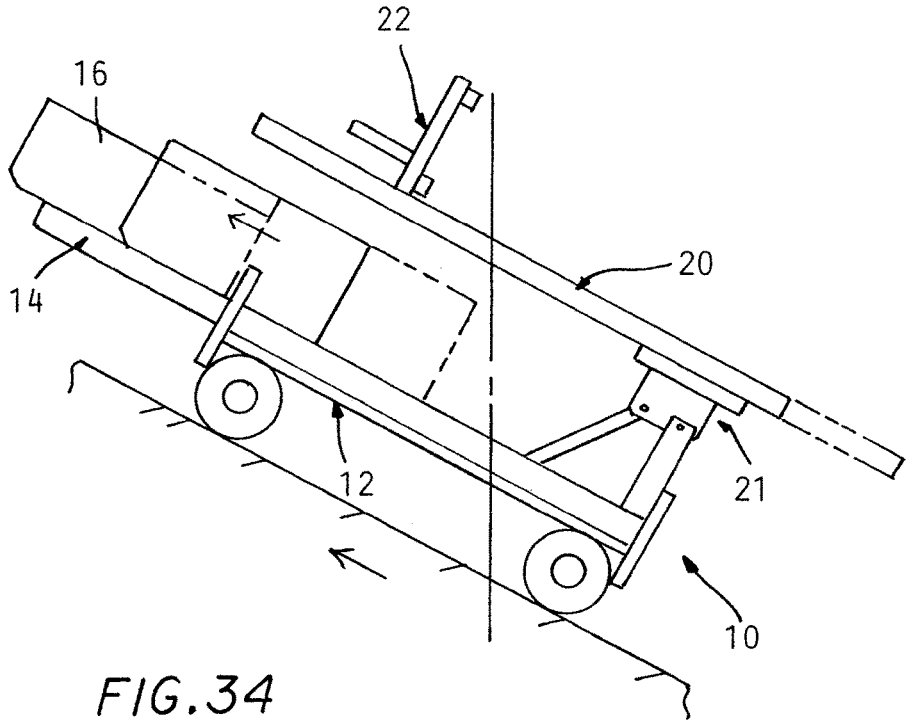
FIG. 34 is a diagrammatic representation of the rig shown in FIG. 32 ascending a grade with movable components positioned to increase the stability of the rig when negotiating a grade in an uphill direction.

Referring to FIGS. 32 and 33, the capability of movement of the slide chassis 16 on the main frame 14 (fixed to the drive chassis 12), the mast 20 on the mast pivot support 21, and the drill head 22 on the mast 20 can be used to increase the stability of the rig 10 when ascending or descending a grade.

That is, when ascending a grade as seen in FIG. 32, the slide chassis 16, the mast 20 and drill head 22 are all shifted in the up direction, relative the drive chassis 12. This counteracts the shifting of the center of gravity of the rig 10 which occurs when inclined by the slope grade.

This will reduce the tendency for the rig to flip back caused by a shift of the center of gravity to the rear of the drilling rig 10.

FIG. 33 shows the drilling rig 10 descending a grade, and the slide chassis 16, the mast 20, and the drill head 22 shifted upwardly. This rebalancing lessens the tendency that the drilling rig 10 will flip backward.

These shifts can be carried out by manual operation of the associated actuators or can be automated by including a center of gravity sensor 174 and actuator control 176 responsive thereto. This will automatically carry out the shift to the extent and direction necessary to limit shifting of the center of gravity of the drilling rig 10 due to the grade being traversed.

Figure 35:
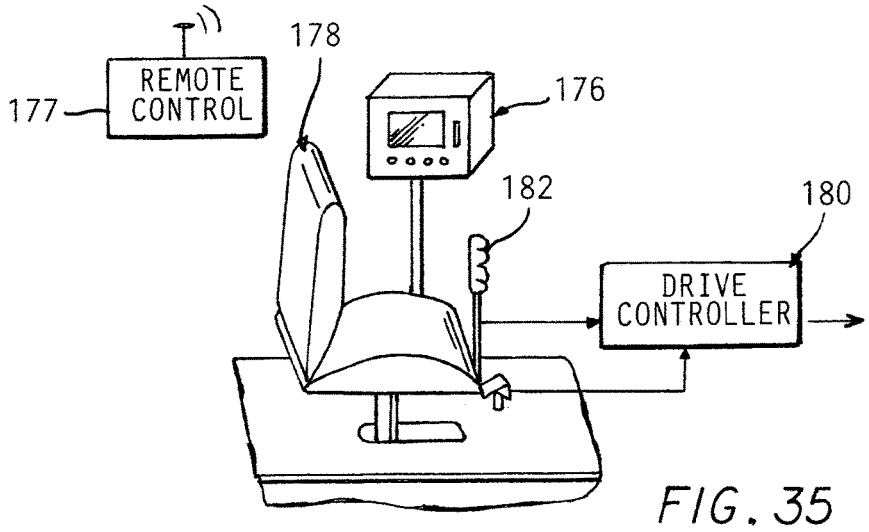
FIG. 35 is a pictorial view of an operator seat and industrial controller with a block diagram depiction of control valving for operating the various actuators and a controller handle for operating the drive components of the mobile drilling rig, and an optional remote control.
Figure 31:
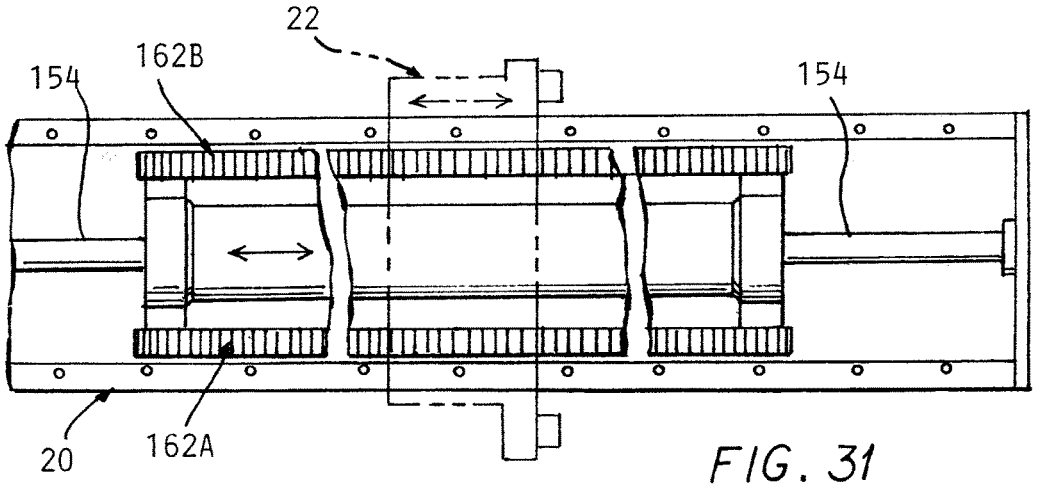
FIG. 31 is a pictorial diagrammatic view of the drill head drive arrangement for achieving increased movement of the drill head on the mast with the mast in a horizontal orientation.

FIG. 35 depicts the use of an industrial controller 176 adjacent the operator's seat 178 enables an operator while in the seat 178 to activate the various actuators.

Also, a commercially available wireless remote controller 177 can optionally be used to allow the operator to be standing somewhere alongside the rig 10.

A drive controller 180 connected to valving may also be provided operated by movement of a handle 182 operating connected valving so as to increase or decrease speed, or turn right or left. Suitable such controllers are known and are commercially available.

A separate brake foot pedal 184 can also interact with the drive controller 180 to conveniently enable braking in the conventional manner.

It should be appreciated that a track or snow drive can be used by detaching the wheeled drive chassis and installing another drive chassis mounting a track or snow drive.

The power plant can be quickly replaced or serviced by detaching the same and installing another engine, etc.

Figure 36:
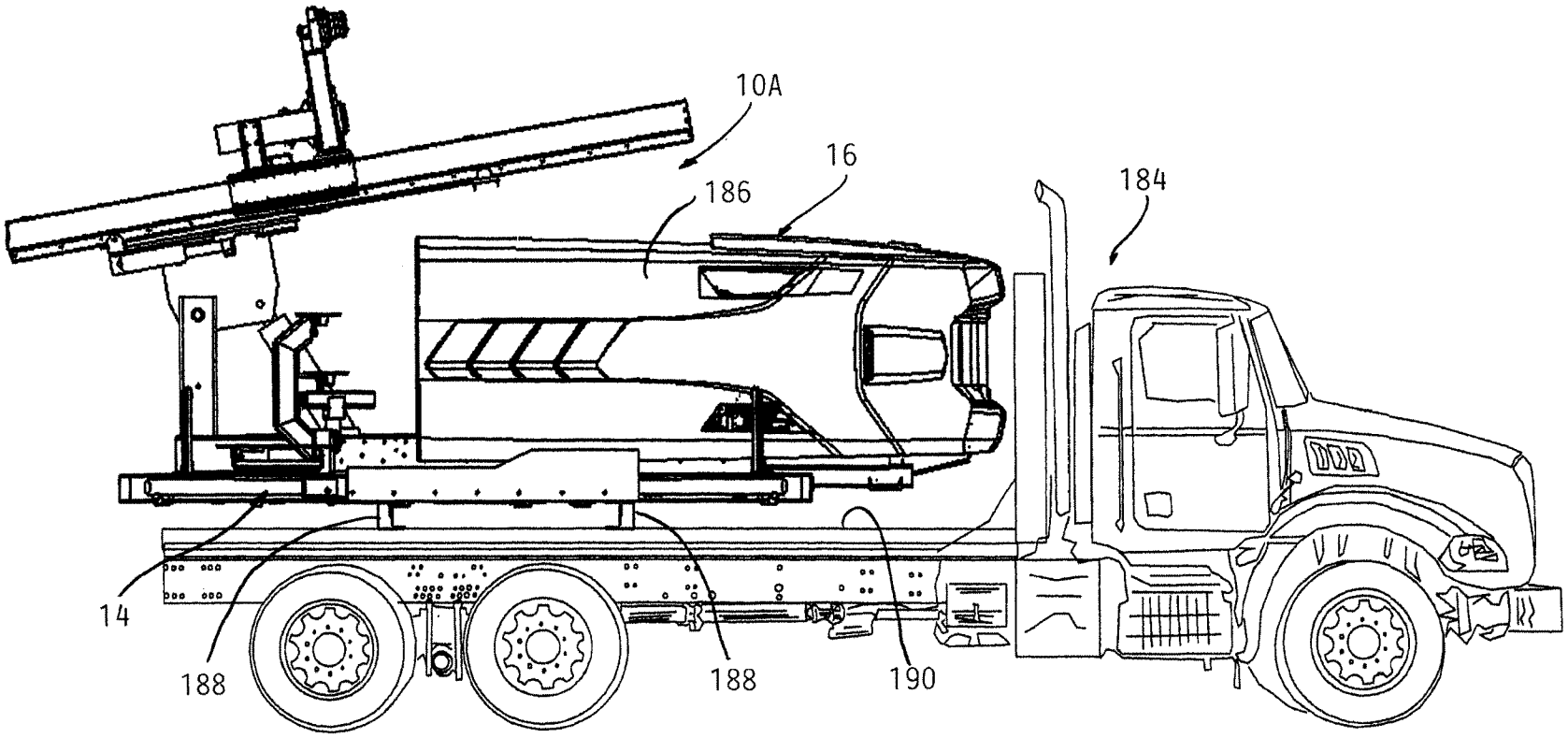
FIG. 36 is a side elevational view of a rig showing the use of a conventional flat bed truck as a drive chassis.

Instead of a drill rig incorporating a drive chassis powered by the power plant, a separate independently powered flat bed truck may provide a drive chassis for the drilling rig 10A as shown in FIG. 36. This may be necessary when transported long distances.

The slide chassis 16 (shown with a cover 186 in place) is preferably moved to its retracted position on the main frame 14 as shown.

Support members 188 are secured to the bed 190 of the flat bed truck 184 and to the main frame 14.

Drilling operations could be carried out using the truck 184, or an integrated drive chassis 12 may separately shipped for use supporting the main frame in the field.

Figure 37:
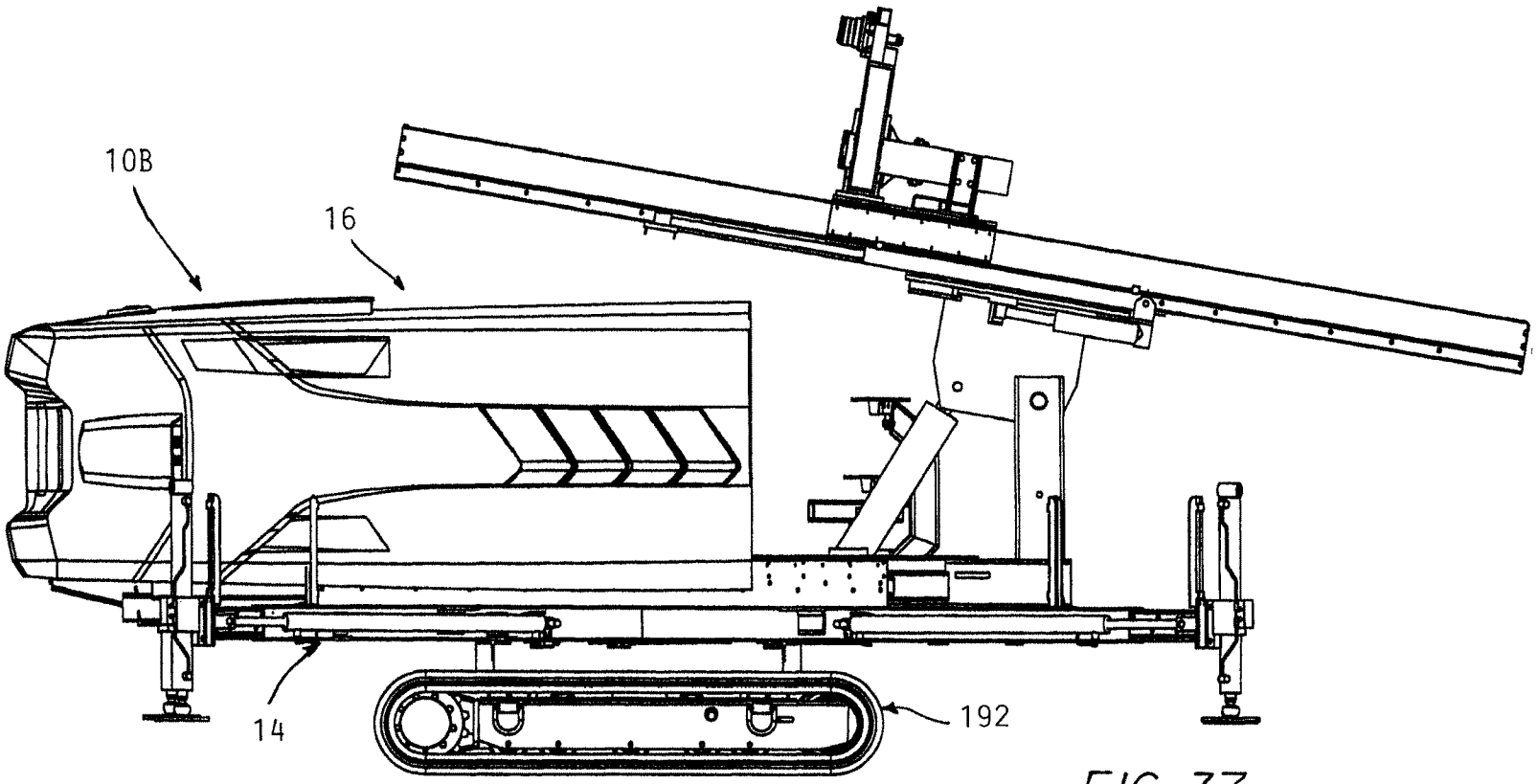
FIG. 37 is a side elevational view of a drilling rig showing use of a tracked drive chassis.
Figure 38:
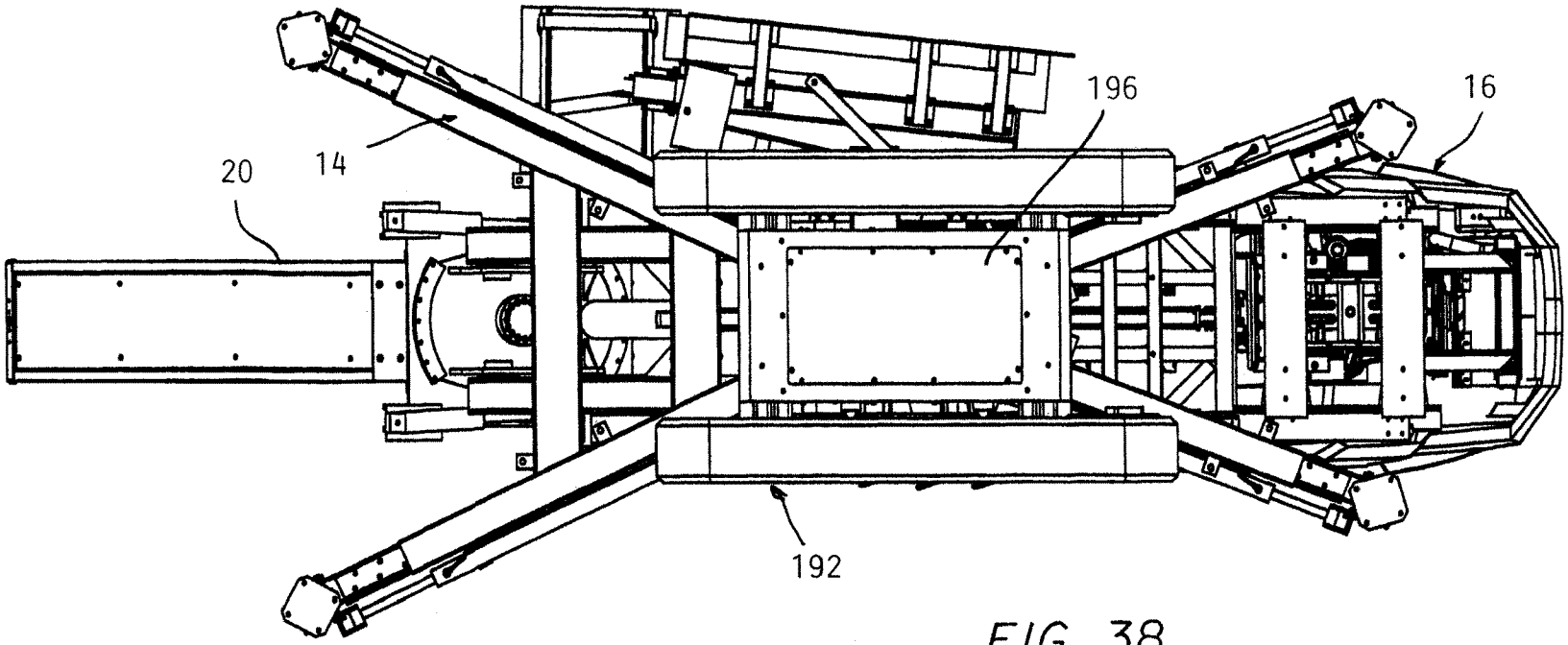
FIG. 38 is a bottom view of the drilling rig using tracked drive chassis shown in FIG. 37.

FIGS. 37 and 38 show a recirculating track drive chassis 192 connected to the main frame 14 by members 194 fixed to a track deck 196 (FIG. 38).

The invention claimed is:

1. A mobile drilling rig comprising:

a generally planar main frame having a power plant supported thereon driving running gear supporting said main frame on a ground surface and adapted to propel said drilling rig over terrain which may slope up or down;

a mast support mounted adjacent to one end of said main frame;

an elongated mast movably mounted on said mast support so as to enable shifting linear movement of said elongated mast in an endwise direction on said mast support by an actuator arrangement operable to shift said elongated mast linearly in an endwise direction on said mast support;

said mast support pivoted adjacent said one end of said main frame and including a pivot actuator able to pivot said mast support so as to swing said elongated mast between an upright position on said main frame and said endwise extending position above and parallel to said main frame;

said elongated mast shiftable linearly back and forth by operation of said actuator arrangement when a length of said elongated mast is positioned extending substantially parallel to said main frame to enable shifting location of the center of gravity of said drilling rig when traversing up or down a terrain slope so as to reduce any tendency of said drilling rig to flip over when moving up or down said terrain slope by shifting said elongated mast towards a higher one of said two opposite ends of said drilling rig created by said terrain slope;

a drill head mounted on said elongated mast able to hold a rotary drilling tool, said drill head movable up and down on said elongated mast to enable drilling into said terrain with said drill tool.

2. The mobile drilling rig according to claim 1 wherein said power plant is supported on a slide chassis movably mounted on said main frame away from said one end of said main frame and enabling linear movement of said slide chassis in a direction parallel to said generally planar main frame;

a controllable slide chassis position actuator which is operable to linearly move said slide chassis on said main frame towards said one of said two opposite ends of said drilling rig which is made higher than the other of said opposite ends of said drilling rig when said drilling rig is moving up or down said terrain slope so as to cause lengthwise shifting of a location of a center of gravity of said drilling rig as said drilling rig moves up or down a terrain slope so as to counteract any affect of said terrain slope on the lengthwise location of said center of gravity of said drilling rig to thereby reduce any tendency of said mobile drilling rig to flip over in a lengthwise direction while being driven up or down the terrain slope.

3. The mobile drilling rig according to claim 2 of said drilling rig further including a center of gravity sensor sensing said location of said center of gravity along the length wherein said drilling rig has a center of gravity which is located along a length of said drilling rig, and said slide chassis position actuator is responsive to said center of gravity sensor to shift said slide chassis linearly towards a higher end of said drilling rig when said drilling rig is traversing sloping terrain to counteract any effect of terrain slope on a location of said center of gravity of said drilling rig.

4. The mobile drilling rig according to claim 2 wherein said power plant comprises an internal combustion engine and further includes a fuel tank which is also mounted on said slide chassis to also be moved linearly by said slide chassis position actuator.

5. The mobile drilling rig according to claim 2 wherein said power plant drives a hydraulic pump and wherein a tank of hydraulic fluid supplying said hydraulic pump is also mounted on said slide chassis to be moved therewith.

6. The mobile drilling rig according to claim 1 wherein said main frame includes four elongated frame members forming an X shape, each having a vertical support mounted on an outer end of a respective frame member.

7. The mobile drilling rig according to claim 1 wherein said mast support includes a pivoted back plate mounted on said mast support to be selectively pivotable towards either of two respective sides of said main frame by one or more back plate pivot actuators to enable pivoting movement of said elongated mast side to side to be angled toward either opposite side directions on said main frame.

8. The mobile drilling rig according to claim 1 wherein said pivoted back plate has guide rails slidably receiving said elongated mast to enable said elongated mast to be moved vertically by one or more actuators when said elongated mast is oriented in upright position on said main frame and in said endwise direction when said elongated mast is positioned substantially parallel to said generally planar main frame.

9. The mobile drilling rig according to claim 1 wherein said drill head mounting includes a double acting power cylinder actuator held on said mast elongated extending in said lengthwise direction on said elongated mast and having an output element selectively driving said drill head lengthwise along said elongated mast in either direction.

10. The mobile drilling rig according to claim 9 wherein a mechanical movement is interposed between said double acting power cylinder actuator and said drill head increasing the extent of movement of said output element of said drill head to be greater than the movement of said double power acting cylinder actuator.

11. The mobile drilling rig according to claim 10 wherein said mechanical movement comprises a chain loop engaged with a respective sprocket on the ends of a power cylinder body comprising said output element, a segment of said chain loop extending between one side of said sprockets fixed at one point to said elongated mast and another segment extending between another side of said sprockets at another spaced point to said drill head, said power cylinder including a rod protruding from either end of said cylinder body fixed to said elongated mast and on which said cylinder is movable in opposite direction.

12. The mobile drilling rig according to claim 1 further including an operator seat mounted to said main frame by a support linkage and one or more support linkage actuators enabling swinging said seat out to one side of said main frame.

13. The mobile drilling rig according to claim 12 wherein said operator seat is also mounted to be movable towards and away from said main frame an associated support linkage actuator.

14. The mobile drilling rig according to claim 1 wherein said running gear includes front and rear wheel sets, both wheel sets driven by a hydraulic motor powered by said power plant.

15. The mobile drilling rig according to claim 14 wherein said power plant includes an internal combustion engine driving a hydraulic pump and further including a hydraulic motor, and wherein said hydraulic motor is operated by hydraulic fluid pressurized by said hydraulic pump, said hydraulic motor driving a transfer case in turn mechanically driving a respective differential for each wheel set.

16. A mobile drilling rig comprising:

a generally planar main frame having opposite ends and a power plant supported on said main frame driving running gear supporting said main frame on a ground surface and adapted to propel said drilling rig over sloping terrain;

an elongated mast;

a mast support holding said elongated mast, said mast support mounted adjacent one of said opposite ends of said main frame;

said mast support pivoted adjacent said one of said opposite ends of said main frame and including an actuator able to pivot said mast support so as to swing said elongated mast between an upright position on said main frame and a lengthwise extending position above and parallel to said main frame;

a drill head mounted on said elongated mast able to hold and rotate a rotary drill tool, said drill head moved up and down by a drill head actuator on said elongated mast to enable drilling holes into said terrain by rotation of said rotary drill tool;

a slide chassis mounted on said main frame and carrying said power plant; and a slide chassis position actuator which when activated moves said slide chassis linearly on said main frame in a direction towards one of said opposite ends of said drilling rig if said one end becomes higher than an opposite end as a result of said drilling rig going up or down a sloping terrain wherein so that said one end becomes higher than said opposite end of said drilling rig so as to cause shifting of a lengthwise location of said center of gravity of said drilling rig as said rig moves up or down sloping terrain so as to counteract the affect of said sloping terrain on said lengthwise location of a center of gravity of said drilling rig to thereby reduce any tendency of said mobile drilling rig to flip over while being driven up or down sloping terrain.

17. The mobile drilling rig according to claim 16 further including a center of gravity sensor, and said slide chassis position actuator responsive to said center of gravity sensor to shift said slide chassis linearly towards said higher end of said drilling rig when said drilling rig is traversing sloping terrain to counteract any effect of terrain slope on said center of gravity of said drilling rig.

18. The mobile drilling rig according to claim 16 wherein said power plant includes an internal combustion engine and further includes a fuel tank which is also mounted on said slide chassis to also be moved by said slide chassis actuator.

19. The mobile drilling rig according to claim 18 wherein said power plant drives a hydraulic pump and wherein a tank of hydraulic fluid supplying said hydraulic pump is also mounted on said slide chassis to be moved therewith.

* * * * *